US006343195B1

(12) United States Patent
Abe et al.

(10) Patent No.: US 6,343,195 B1
(45) Date of Patent: Jan. 29, 2002

(54) IMAGE HEATING APPARATUS WITH CORE FOR GUIDING MAGNETIC FLUX AND TEMPERATURE SENSOR TO CONTROL POWER SUPPLY

(75) Inventors: Atsuyoshi Abe, Shizuoka-ken; Hideo Nanataki, Tokyo; Tetsuya Sano, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/558,116

(22) Filed: Apr. 25, 2000

Related U.S. Application Data

(62) Division of application No. 08/980,408, filed on Nov. 28, 1997, now Pat. No. 6,072,964.

(30) Foreign Application Priority Data

Nov. 28, 1996 (JP) ..... 8-317899

(51) Int. Cl.[7] ..... G03G 15/20
(52) U.S. Cl. ..... 399/69; 399/330
(58) Field of Search ..... 399/33, 69, 328, 399/330, 336

(56) References Cited

U.S. PATENT DOCUMENTS

| | | | | |
|---|---|---|---|---|
| 5,196,895 A | | 3/1993 | Setoriyama et al. | 355/285 |
| 5,278,618 A | | 1/1994 | Mitani et al. | 355/285 |
| 5,552,582 A | | 9/1996 | Abe et al. | 219/619 |
| 5,745,833 A | | 4/1998 | Abe et al. | 399/330 |
| 5,765,075 A | | 6/1998 | Yamamoto | 399/69 |
| 5,783,806 A | | 7/1998 | Hayasaki | 219/635 |
| 5,802,421 A | | 9/1998 | Miura | 399/33 |
| 5,940,655 A | | 8/1999 | Sano et al. | 399/69 |
| 6,072,964 A | * | 6/2000 | Abe et al. | 399/69 |

FOREIGN PATENT DOCUMENTS

| | | |
|---|---|---|
| JP | 8-6413 | 1/1996 |

* cited by examiner

*Primary Examiner*—Fred L Braun
(74) *Attorney, Agent, or Firm*—Fitzpatrick, Cella, Harper & Scinto

(57) ABSTRACT

An image heating apparatus has an endless movable member together with a coil for generating a magnetic flux and a core for guiding the magnetic flux. A backup member for forming a nip with the movable member has associated therewith a temperature detecting device so that power supply to the coil may be controlled on the basis of an output of that temperature detecting device, the core being sandwiched by the coil at a position upstream of the nip with respect to a movement direction of an outer periphery of the movable member and the temperature detecting device being disposed downstream of the nip.

7 Claims, 16 Drawing Sheets

IMAGE HEATING APPARATUS WITH CORE FOR GUIDING MAGNETIC FLUX AND TEMPERATURE SENSOR TO CONTROL POWER SUPPLY

This application is a divisional of application Ser. No. 08/980,408, filed Nov. 28, 1997, now U.S. Pat. No. 6,072,964.

FIELD OF THE INVENTION AND RELATED ART

The present invention relates to an image heating apparatus suitable for an image forming apparatus such as a copying machine or a printer. In particular, it relates to an image heating apparatus which generates heat through electromagnetic induction.

For the sake of convenience, the present invention will be described with reference to an image heating apparatus (fixing apparatus) which is employed in such an image forming apparatus as a copying machine or a printer, to thermally fix a toner image to recording medium.

In an image forming apparatus, an image (toner image) is formed in an image forming station which employs a given image forming process such as an electrophotographic process, an electrostatic recording process, or a magnetic recording, is transferred onto, or directly deposited on, the recording medium (transfer sheet, electro-fax sheet, electrostatic recording sheet, OHP sheet, printing paper, formatted paper, and the like), and then is thermally fixed as a permanent image onto the surface of the recording medium by a fixing apparatus. As for such a fixing apparatus, a thermal roller type apparatus has been widely in use. However, recently, a heating apparatus which employs a film type heating system has been put to practical use, and also, a heating apparatus based on electromagnetic induction has been proposed.

FIG. 21 illustrates the essential structure of a typical electromagnetic induction based fixing apparatus in accordance with the prior technology on which the present invention is based.

A referential FIG. 10 designates a cylindrical fixing film as a rotatory member which generates heat through electromagnetic induction. The fixing film 10 comprises a heat generating layer (electrically conductive layer, magnetic layer, resistive layer) which electromagnetically generates heat.

A referential FIG. 16 designates a film guide in the form of a trough having a substantially semicircular cross section. The cylindrical fixing film 10 is loosely fitted around this film guide 16.

A referential FIG. 15 designates a means for generating a magnetic field, which is disposed on the inward side of the film guide 16, and is constituted of an excitation coil 18 and a magnetic core 17.

A referential FIG. 30 designates an elastic pressure roller, which is disposed so that it presses, with a predetermined pressure, upon the bottom surface of the film guide 16, with the fixing film interposed, and forms a fixing nip N having a predetermined width. The magnetic core 17 of the magnetic field generating means 15 is squarely aligned with the fixing nip N.

The pressure roller 30 is rotatively driven in the counterclockwise direction, indicated by an arrow mark, by a driving means M. As the pressure roller 30 is rotatively driven, the fixing film 10 is driven in the clockwise direction indicated by another arrow mark, by the friction between the pressure roller 30 and the outward surface of the fixing film 10, with the inward surface of the fixing film 10 sliding flatly on the bottom surface of the film guide 16; the fixing film 10 is rotated along the outward surface of the film guide 16 at a peripheral velocity substantially equal to the peripheral velocity of the pressure roller 30 (pressure roller driving system).

The film guide 16 plays a role in generating pressure in the fixing nip N, supporting the excitation coil 18 and magnetic core 17 of the magnetic field generating means 15, supporting the fixing film 10, and stabilizing the conveyance of the fixing film 10 while the fixing film 10 is rotatively driven. The film guide 16 is formed of dielectric material which does not interfere with the permeation of magnetic flux, and also is capable of withstanding the load it must bear.

The excitation coil 18 generates an alternating magnetic flux as it is supplied with an alternating electric current by an unillustrated excitation circuit. Since the alternating magnetic flux is generated so as to be concentrated to the fixing nip N, the heat generated through electromagnetic induction is also concentrated to the fixing nip N. In other words, the fixing nip N is very efficiently heated.

The temperature of the fixing nip N is controlled by a temperature controlling system inclusive of a temperature detecting means; it is maintained at a predetermined level by controlling the current supplied to the excitation coil 18.

Reviewing the above description, as the pressure roller 30 is rotatively driven, the cylindrical fixing film 10 is rotated around the film guide 16, and electrical current is supplied to the excitation coil 18 from the excitation circuit to generate heat in the fixing film 10 through electromagnetic induction. As a result, the temperature of the fixing nip N is increased. As the temperature of the fixing nip N reaches the predetermined level, it is maintained at this level. With the heating apparatus in this state, a recording medium P, on which a toner image t has been just deposited without being fixed thereto, is introduced into the fixing nip N, between the fixing film 10 and the pressure roller 30, with the image bearing surface of the recording medium P facing upward so that it will come in contact with the outward surface of the film 10. Then, the recording medium P is passed through the fixing nip N, along with the fixing film 10, while being compressed by the pressure roller 30 and the film guide 16, with the image bearing surface being flatly in contact with the outward surface of the fixing film 10. While the recording medium P with the toner image t is passed through the fixing nip N as described above, the toner image t which is borne on the recording medium P, but is yet to be fixed, is heated by the heat electromagnetically induced in the fixing film 10, being thereby fixed to the recording medium P. After passing through the fixing nip N, the recording medium P separates from the outward surface of the rotating fixing film 10, and is conveyed further to be discharged from the image forming apparatus.

In terms of preciseness in heating a toner image using a fixing apparatus which employs an electromagnetic induction system such as the system described above, it is desirable that the temperature detecting means of the fixing apparatus detects the temperature of the fixing film 10 itself, which actually comes in contact with the toner image t. However, if a temperature detection element for measuring the temperature of the fixing film 10 is placed in contact with the outward surface of the fixing film 10, the film surface is liable to be damaged, and if the film surface is damaged, the damaged surface causes the offset of the fixed toner image. This is one of the problems of the image heating apparatus based on the prior art. In addition, if the fixing film 10 is rotated at an extremely high speed, it is rather difficult to maintain stable contact between the temperature detection element and the fixing film 10, hence the accuracy of the detected temperature deteriorates. As a result, the temperature of the fixing film 10 cannot be reliably controlled, which is another problem.

SUMMARY OF THE INVENTION

The object of the present invention is to provide an image heating apparatus capable of detecting the temperature of a moving member without damaging the surface of the moving member which generates heat through electromagnetic induction.

Another object of the present invention is to provide an image heating apparatus in which stable contact is maintained between a moving member which generates heat through electromagnetic induction, and a temperature detecting means.

Another object of the present invention is to provide an image heating apparatus in which a temperature detecting means is in contact with the inward facing surface of an endless moving member which generates heat through electromagnetic induction.

These and other objects, features and advantages of the present invention will become more apparent upon a consideration of the following description of the preferred embodiments of the present invention, taken in conjunction with the accompanying drawings.

DETAILED DESCRIPTION OF THE PREFERRED EMBODIMENTS

Hereinafter, the embodiments of the present invention will be described with reference to the drawings.

(1) Image Forming Apparatus in Accordance with the Present Invention

Figure 1:
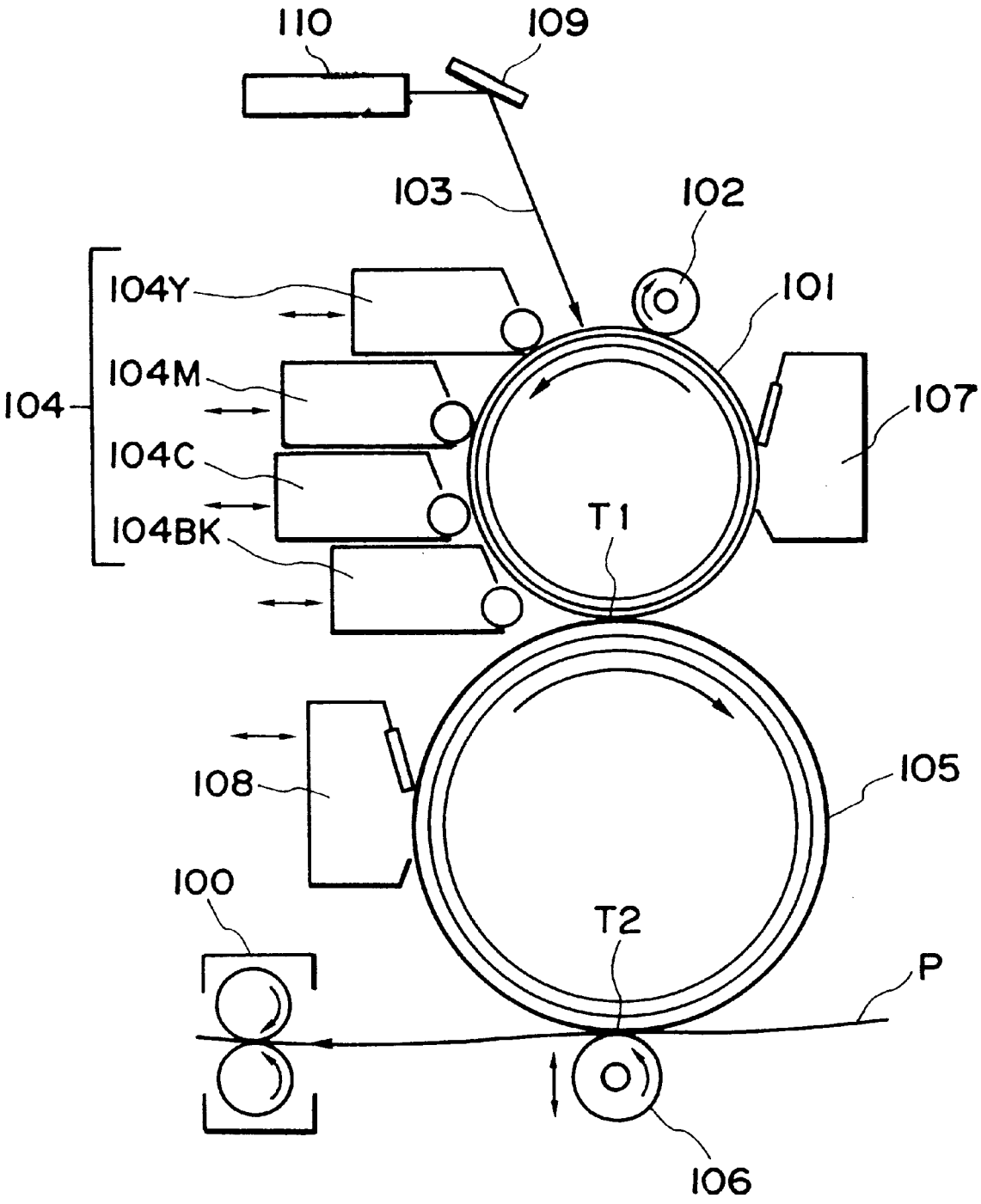
FIG. 1 is a schematic illustration of an image forming apparatus which employs the fixing apparatus in an embodiment of the present invention, and it depicts the general structure the fixing apparatus.

FIG. 1 is a schematic vertical section of a typical image forming apparatus compatible with any of the image heating apparatuses in the following embodiments of the present invention.

A referential figure 101 designates a photosensitive drum (image bearing member) composed of organic photosensitive material, or amorphous silicon, and rotatively driven in the counterclockwise direction indicated by an arrow mark, at a predetermined process speed (peripheral velocity).

The photosensitive drum 101 is uniformly charged to predetermined polarity and potential by a charging apparatus 102 such as a charge roller.

The uniformly charged surface of the photosensitive drum 101 is exposed to a scanning laser beam 103 which carries the image data of a target image, and is projected from a laser optical box (laser scanner) 110; the laser optical box 110 projects the laser beam 103 while modulating it (on/off) in accordance with sequential electrical digital signals which reflect the image data of the target image. As a result, an electrostatic latent image correspondent to the image data of the target image is formed on the peripheral surface of the rotatory photosensitive drum 101. The sequential electrical digital signals are supplied from an image signal generation apparatus such as an image reading apparatus, which is not illustrated in the drawing. A referential figure 109 designates a mirror which deflects to the laser beam projected from the laser optical box 110, onto a point to be exposed on the photosensitive drum 101.

In full-color image formation, a target image is subjected to a color separation process in which the color of the target image is separated into, for example, four primary color components. Then, the above described scanning exposure and image formation processes are carried out for each of the primary color components, starting from, for example, yellow component. The latent image correspondent to the yellow color component is developed into a yellow toner image by the function of a yellow color component developing device 104Y of a color developing device 104. Then, the yellow toner image is transferred onto the peripheral surface of an intermediary transfer drum 105, at a primary transfer point $T_1$, which is the contact point of the photosensitive drum 101 and the intermediary transfer drum 105 (or the point at which the distance between the photosensitive drum 101 and the intermediary transfer drum 105 becomes smallest). After the toner image is transferred onto the surface of the intermediary transfer drum 105, the peripheral surface of the photosensitive drum 101 is cleaned by a cleaner 107; foreign matters such as the residual toner particles from the transfer are removed from the peripheral surface of the photosensitive drum 101 by the cleaner 107.

Next, a process cycle comprising the above described charging process, scanning/exposing process, developing process, primary transfer process, and cleaning process is also carried out for the rest (second, third, and fourth) of the primary color components of the target image. More specifically, for the latent image correspondent to the second primary color component, that is, magenta color component, a magenta color component developing device 104M is activated; for the latent image correspondent to the third primary color components, a cyan color component developing device 104C; and for the latent image for the fourth color component, a black color component developing device 104BK is activated. As a result, a yellow toner image, a magenta toner image, a cyan toner image, and a black toner image are superposed in the aforementioned order on the peripheral surface of the intermediary transfer drum 105, effecting a compound full-color toner image of the target image.

The intermediary transfer drum 105 comprises a metallic drum, an elastic middle layer with medium resistance, and a surface layer with high resistance. It is disposed so that its peripheral surface is placed in contact with, or extremely close to, the peripheral surface of the photosensitive drum 101. It is rotatively driven in the counterclockwise direction indicated by the arrow mark, at substantially the same peripheral velocity as that of the photosensitive drum 101. The toner image on the photosensitive drum 101 is transferred onto the peripheral surface of the intermediary transfer drum 105 using the potential difference created by applying a bias voltage to the metallic drum of the intermediary transfer drum 105.

The compound full-color toner image formed on the peripheral surface of the intermediary transfer drum 105 is transferred onto the surface of a recording medium P, at a secondary transfer point $T_2$, that is, a contact nip between the intermediary transfer drum 105 and a transfer roller 106. The recording medium P is delivered to the secondary transfer point $T_2$ from an unillustrated sheet feeding portion with a predetermined timing. The transfer roller 106 transfers all at once the compound color. toner image from the peripheral surface of the intermediary transfer drum 105 onto the recording medium P by supplying the recording medium P with charge having such polarity that is opposite to the polarity of the toner, from the back side of the recording medium P.

After passing through the secondary transfer point $T_2$, the recording medium P is separated from the peripheral surface of the intermediary transfer drum 105, and then is introduced into an image heating apparatus (fixing apparatus) 100, in which the compound full-color toner image composed of layers of toner particles of different color is thermally fixed to the recording medium P. Thereafter, the recording medium P is discharged from the image forming apparatus into an unillustrated delivery tray. The fixing apparatus 100 will be described in detail in section (2).

After the compound full-color toner image has been transferred onto the recording medium P, the intermediary transfer drum 105 is cleaned by a cleaner 108; the residue, such as the residual toner from the secondary transfer or paper dust, on the intermediary transfer drum 105 is removed by the cleaner 108. Normally, the cleaner 108 is kept away from the intermediary transfer drum 105, and when the full-color toner image is transferred from the intermediary transfer drum 105 onto the recording medium P (secondary transfer), the cleaner 108 is placed in contact with the intermediary transfer drum 105.

Also, the transfer roller 106 is normally kept away from the intermediary transfer drum 105, and when the full-color toner image is transferred from the intermediary transfer drum 105 onto the recording medium P (secondary transfer), the transfer roller 106 is pressed on the intermediary transfer drum 105, with the interposition of the recording medium P.

The image forming apparatus illustrated in FIG. 1 can be operated in a monochromatic mode, for example, a black-and-while mode. It also can be operated in a double-sided mode, as well as a multi-layer printing mode.

In a double-sided mode, after an image is fixed to one (first) of the surfaces of the recording medium P, the recording medium P is delivered to an unillustrated recirculating mechanism, in which the recording medium P is turned over, and then, is fed into the secondary transfer point $T_2$ for the second time so that another toner image is transferred onto the other (second) surface. Then, the recording medium P is sent into the image heating apparatus for the second time, in which the second toner image is fixed. Therefore, the recording medium P is discharged as a double-side print from the main assembly of the image forming apparatus.

In a multi-layer mode, after coming out of the image heating apparatus 100, with the first image on the first surface, the recording medium P is sent into the secondary transfer point $T_2$ for the second time, without being turned over through the recirculating mechanism. Then, the second image is transferred onto the first surface, to which the first image has been fixed. Then, the recording medium P is introduced into the image heating apparatus 100 for the second time, in which the second toner image is fixed. Thereafter, the recording medium P is discharged as a multi-layer image print from the main assembly of the image forming apparatus.

The toner used in this embodiment is such toner that contains ingredients which control the excessive softening of the toner.

(2) Fixing Apparatus 100

Figure 2:
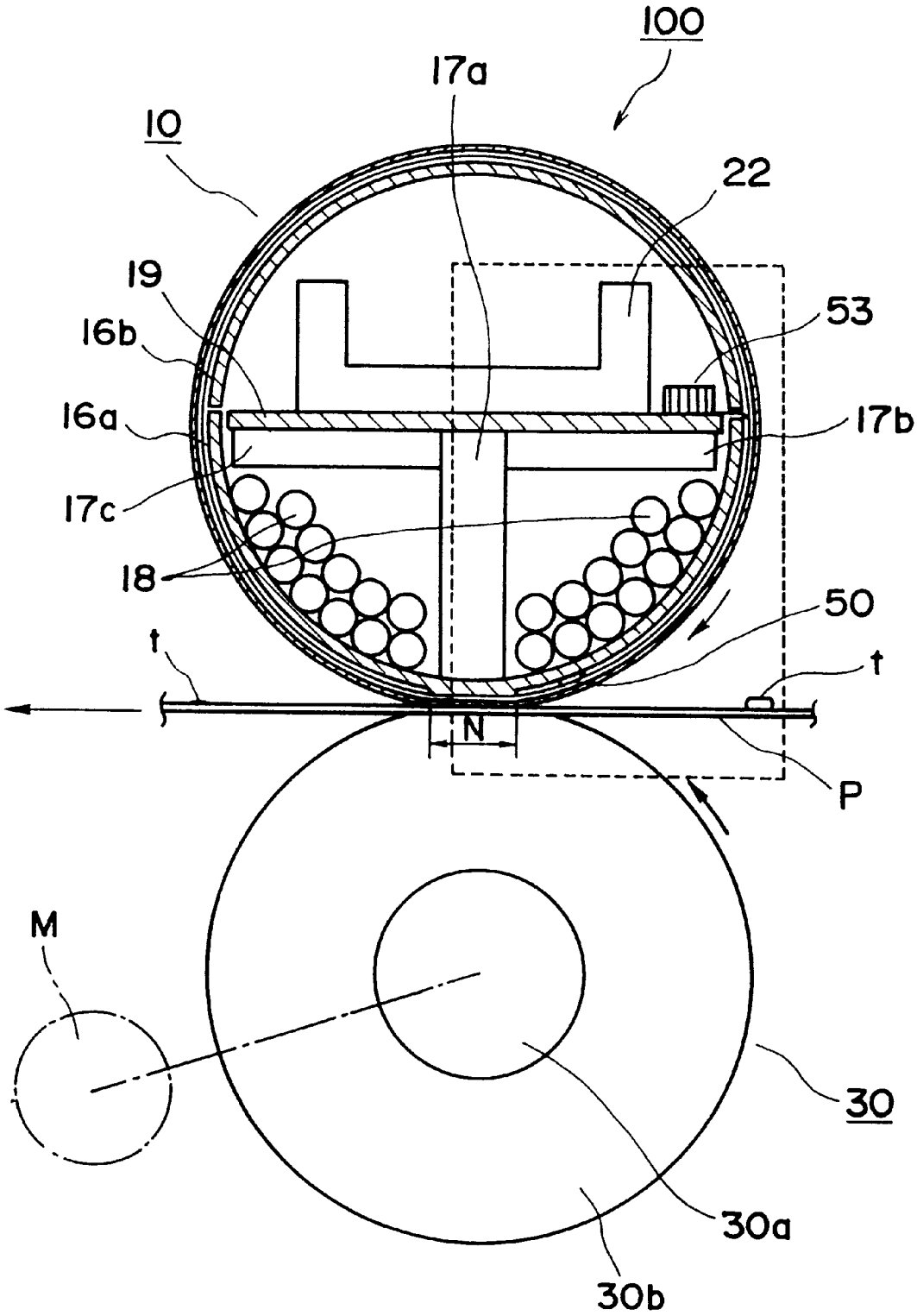
FIG. 2 is a schematic cross section of the essential portion of a fixing apparatus as a heating apparatus.
Figure 3:
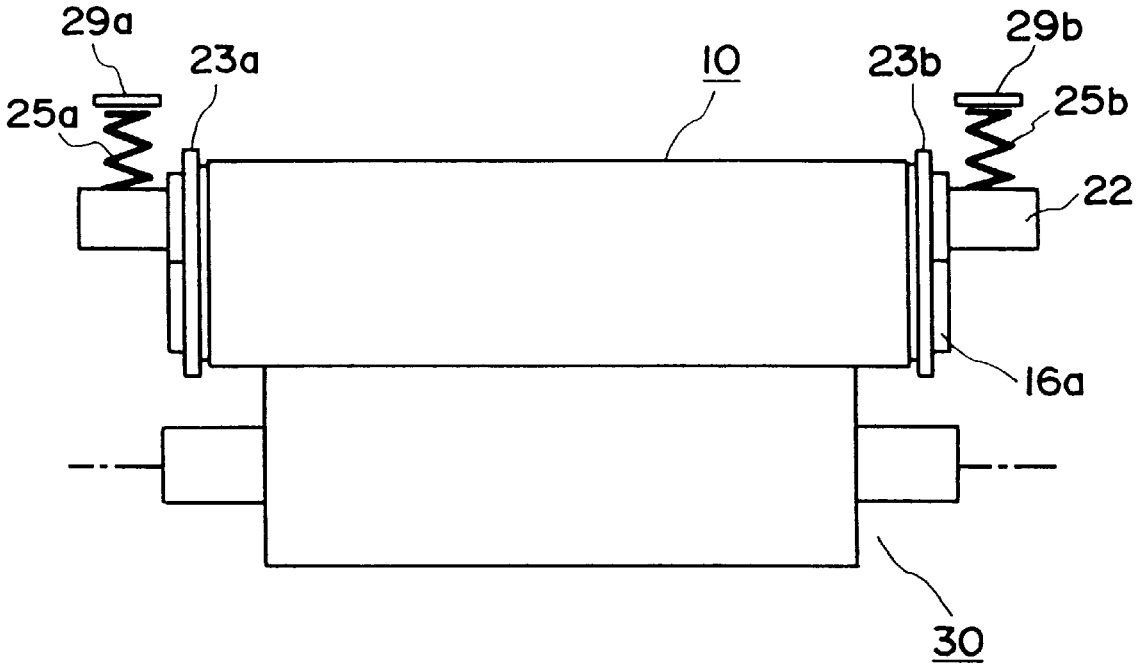
FIG. 3 is a schematic front view of the essential portion of the heating apparatus illustrated in FIG. 2.
Figure 4:
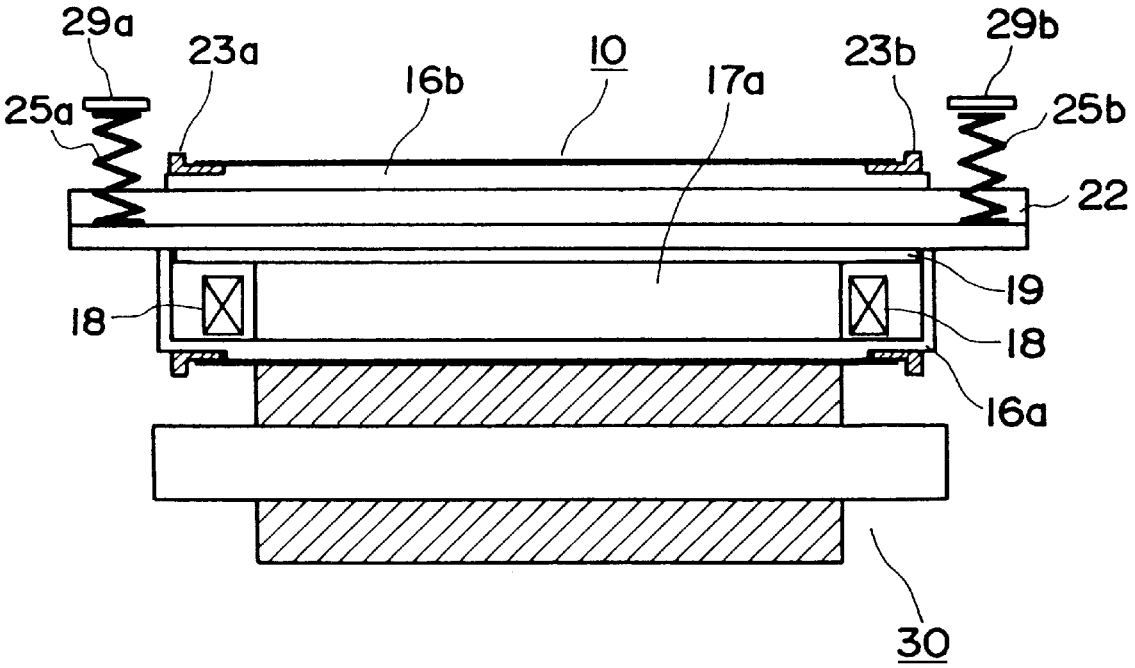
FIG. 4 is a schematic longitudinal section of the essential portion of the heating apparatus illustrated in FIG. 2.

FIG. 2 is a schematic cross section of the essential portion of the fixing apparatus 100 in this embodiment, and FIG. 3 is a schematic front view of the portion illustrated in FIG. 2. FIG. 4 is a longitudinal, vertical section of the portion illustrated in FIG. 2.

Figure 21:
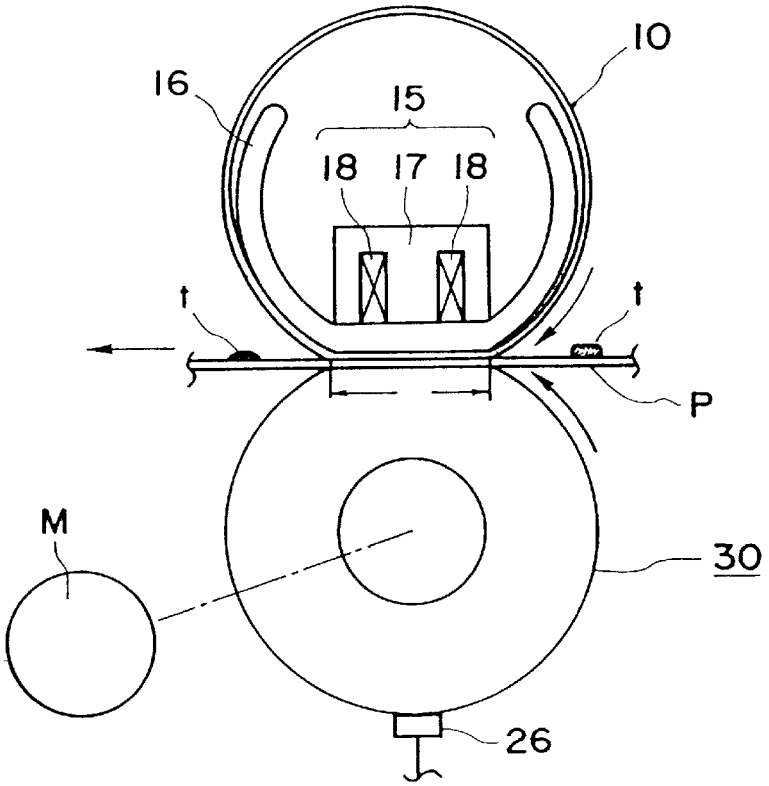
FIG. 21 PRIOR ART
FIG. 21 is a schematic cross section of an electromagnetic induction type heating apparatus based on the prior technology, or the background technology of the present invention.

The fixing apparatus 100 is the same type of apparatus as the fixing apparatus illustrated in FIG. 21, hence it employs a cylindrical film, that is, the rotatory member, which generates heat through electromagnetic induction, and is driven by a pressure roller. Therefore, its components or portions which are the same as those of the apparatus illustrated in FIG. 21 are designated with the same referential codes to eliminate repetition of the same descriptions.

Magnetic cores 17*a*, 17*b* and 17*c* are members with high magnetic permeability. As for the material for these cores, material such as ferrite or permalloy which is used as the material for a transformer core is desirable; preferably, ferrite in which loss is small even when operational frequency is above 100 kHz.

A referential code 16*a* designates a film guide in which the magnetic cores 17*a*, 17*b* and 17*c*, and an excitation coil 18, are disposed. A referential code 16*b* designates a top film guide, which is in the form of a trough with a substantially semicircular cross section, and is placed on top of the film guide 16*a* in a manner to cover the opening of the film guide 16*a*, forming a substantially cylindrical column, together with the film guide 16*a*.

Around the assembly constituted of the film guides 16*a* and 16*b*, the electromagnetic induction based heat generating endless (cylindrical) film 10 (fixing film), that is, the movable member, is loosely fitted.

A referential figure 22 designates a rigid pressing stay, which is oblong and is placed in contact with the flat top portions of the film guide 16*a* in which the magnetic cores 17*a*, 17*b*, and 17*c*, and the excitation coil 18, are disposed.

Figure 19:
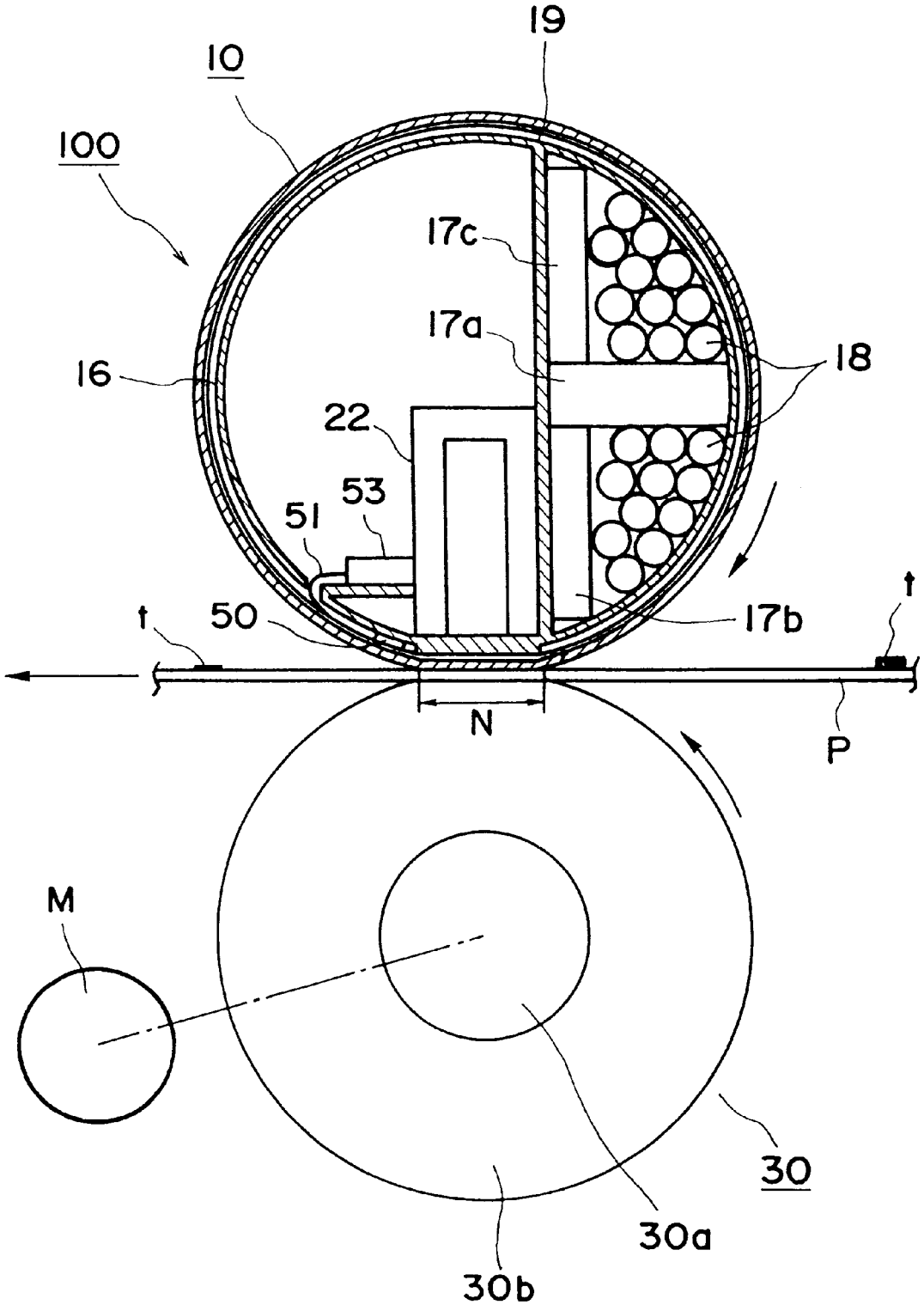
FIG. 19 is a schematic cross section of the fixing apparatus in another embodiment of the present invention.

Designated with a referential figure 19 is an electrically insulative member which electrically insulates between the magnetic core 18 and the rigid pressing stay 22.

Referential codes 23*a* and 23*b* designate flanges, which are fitted, one for one, around the longitudinal ends of the assembly constituted of the film guides 16*a* and 16*b*, to regulate the edges of the fixing film 10 and retain the fixing film 10. They are capable of following the rotation of the fixing film 10.

The pressure roller 30 as a backup member comprises a metallic core 30*a* and an elastic layer 30*b*. The elastic layer 30*b* is concentrically formed around the metallic core 30*a*, covering the peripheral surface of the core 30*a*, and is composed of heat resistant material such as silicone rubber, fluorinated rubber, fluorinated resin, or the like. The pressure roller 30 is fitted between unillustrated side plates of the main assembly of the image forming apparatus, being rotatively supported by bearings, at the respective longitudinal ends of the metallic core 30*a*.

On the top side of the pressure roller 30, a heating means unit, which comprises the aforementioned film guide 16*a*, magnetic cores 17*a*, 17*b* and 17*d*, excitation coil 18, tip film guide 16*b*, rigid pressure stay 22, insulative member 19, fixing film 10, flanges 23*a* and 23*b*, etc., is disposed with the semicircular bottom side of the film guide 16*a* facing downward. Between the longitudinal ends of the rigid pressing stay 22, and the spring seats 29*a* and 29*b*, springs 25*a* and 25*b* are fitted, respectively, in a state of compression, to press the rigid pressing stay 22 downward. With this arrangement, a fixing nip N with a predetermined width is formed, in which the fixing film 10 is sandwiched between the bottom surface of the film guide 16*a* and the upward facing peripheral surface of the pressure roller 30. The bottom surface of the magnetic core 17*a* is squarely aligned with the fixing nip N, sandwiching the bottom portion of the film guide 16*a*.

The pressure roller 30 is rotatively driven by a driving means M in the counterclockwise direction indicated by an arrow mark. As the pressure roller 30 is rotationally driven, rotational force is applied to the fixing film 10 by the friction between the pressure roller 30 and the outward surface of the fixing film 10, whereby the fixing film 10 is rotated along the peripheral surfaces of the film guides 16*a* and 16*b* in the clockwise direction indicated by another arrow mark, at a peripheral velocity substantially equal to the peripheral velocity of the pressure roller 30. In the fixing nip N, the inward surface of the fixing film 10 slides on the bottom surface of the film guide 16*a*, flatly in contact with the surface.

With the above setup, in order to reduce the friction between the bottom surface of the film guide 16*a* and the inward surface of the fixing film 10, lubricant such as heat resistant grease may be placed between the bottom surface of the film guide 16*a* and the inward surface of the fixing film 10, or the bottom surface of the film guide 16*a* may be coated with lubricous material such as mold releasing agent.

The film guide 16*a* applies pressure to the fixing nip N, and supports the magnetic cores 17*a*, 17*b* and 17*c*, and the excitation coil 18. Also, it supports the fixing film 10 in cooperation with the top film guide 16*b*, playing a role in providing the fixing film 10 with stability when the fixing film 10 is rotated.

Figure 5:
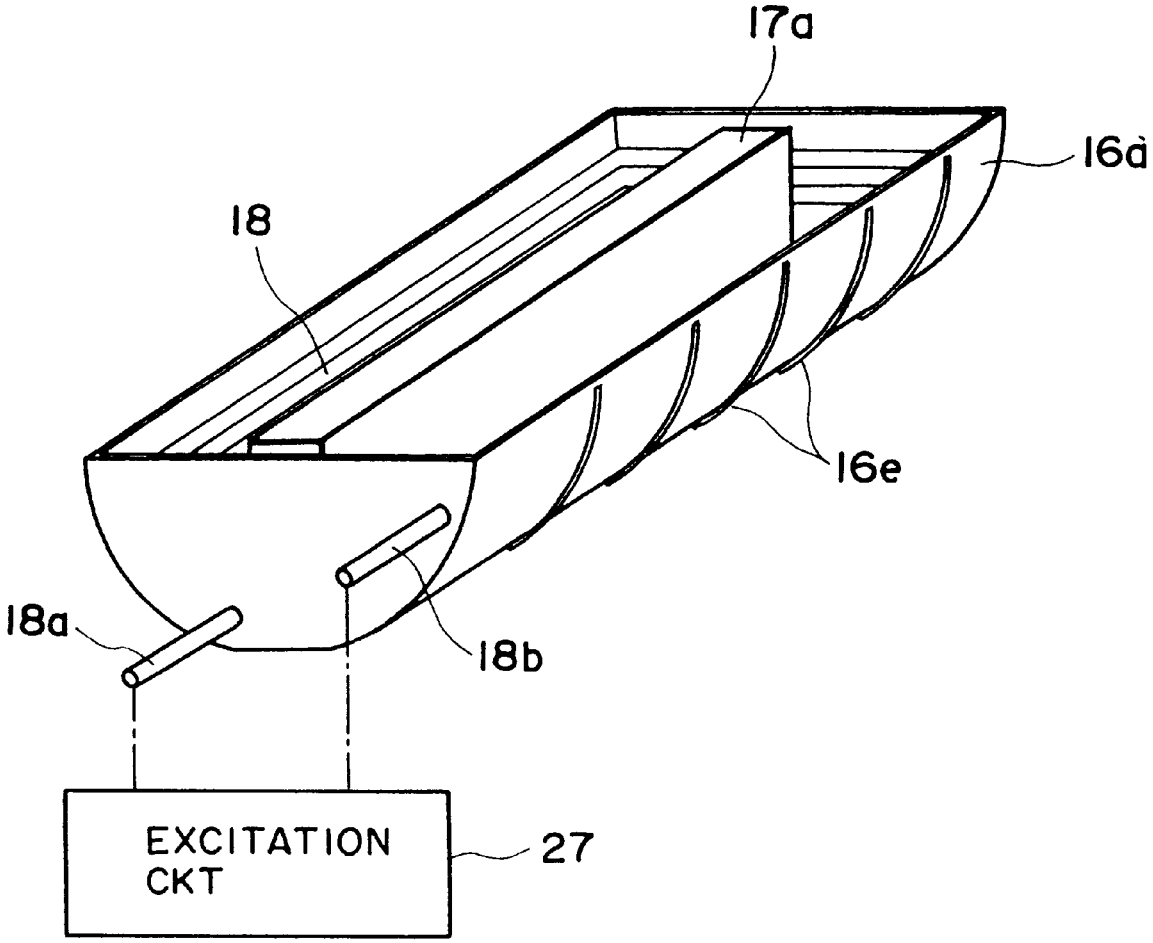
FIG. 5 is a perspective view of a film guide, an excitation coil, and a magnetic core.

FIG. 5 is a perspective view of the film guide 16*a*, in which the magnetic cores 17*b* and 17*c* are not illustrated. A referential code 16*e* designates each of a plurality of ribs which protrude outward from the peripheral surface of the film guide 16*a*, and run in parallel in the circumferential direction, with equal intervals. These protuberant ribs 16*e* are effective to reduce the friction between the outward surface of the film guide 16*a* and the inward surface of the fixing film 10, so that the rotational load borne by the fixing film 10 is reduced. The film guide 16*b* may also be provided with protuberant ribs similar to these ribs 16*b*.

The excitation coil 18 disposed within the film guide 16*a* is connected to an excitation circuit 27 through the power supply lead wires 18*a* and 18*b* of the excitation coil 18. This excitation circuit 27 is capable of generating high frequency waves ranging from 20 kHz to 500 kHz with the use of a switching power source. The excitation coil 18, the magnetic cores 17*a*, 17*b*, and 17*c*, the excitation circuit 27, etc., constitute a means for generating magnetic flux.

The excitation coil 18 within the film guide 16*a* is caused to generate alternating magnetic flux, by alternating current (high frequency current) supplied from the excitation circuit 27.

Figure 6:
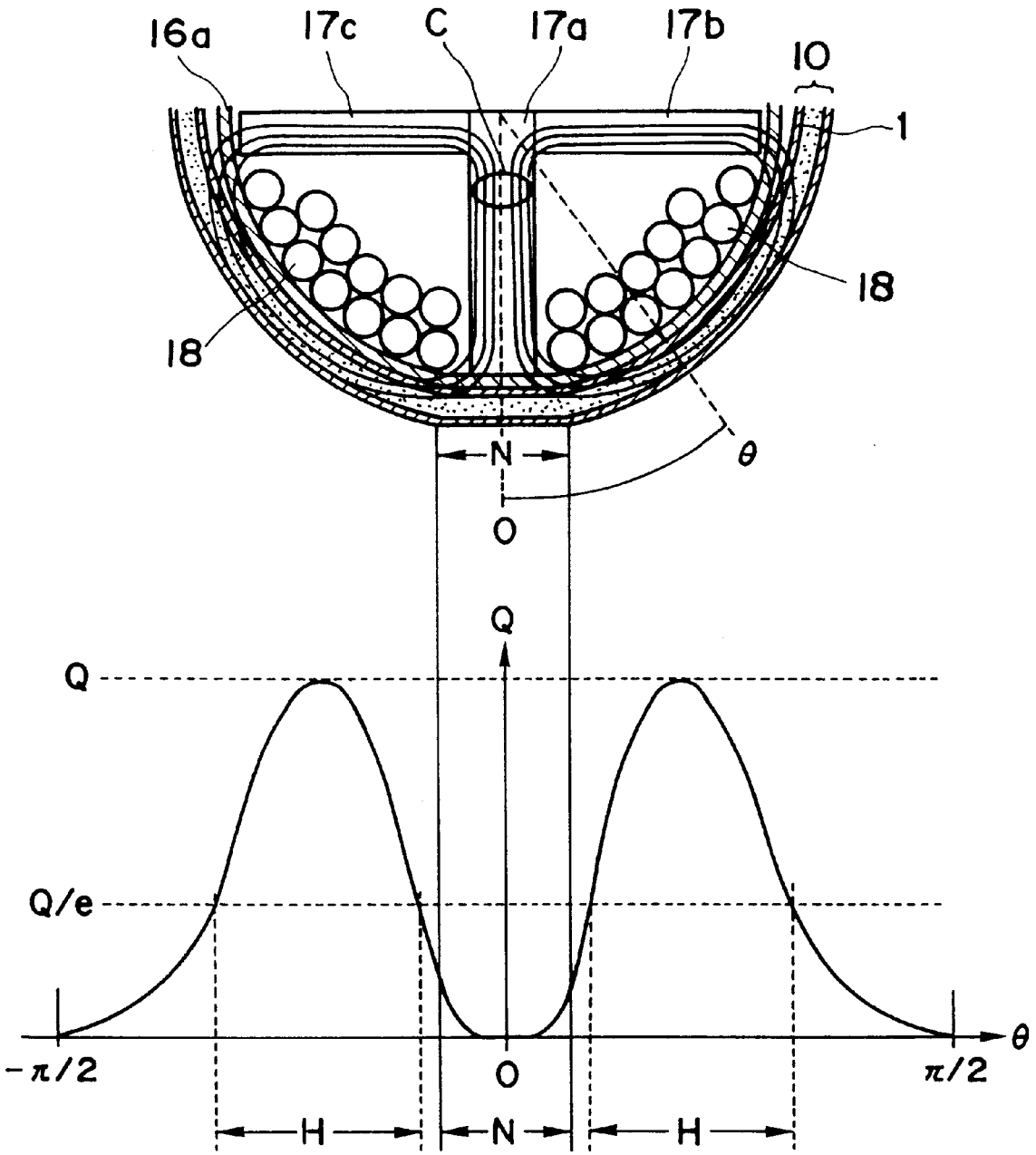
FIG. 6 is an explanatory drawing which depicts the relationship between magnetic flux and the amount of heat generated by a fixing film.

FIG. 6 schematically depicts the direction and distribution of the alternating magnetic flux adjacent to the fixing nip N. A magnetic flux C represents a portion of the alternating magnetic flux.

As for the distribution of the alternating magnetic flux (C), the alternating magnetic flux (C) is guided by the magnetic cores 17*a*, 17*b*, and 17*c* to be concentrated between the magnetic cores 17*a* and 17*b*, and between the magnetic cores 17*a* and 17*c*, generating eddy current in the electromagnetic induction based heat generating layer 1 of the fixing film 10. This eddy current generates Joule heat (eddy current loss) in the electromagnetic induction based heat generating layer 1, in accordance with the specific resistance of the heat generating layer 1. The amount of the heat generated by the electromagnetic induction based heat generating layer 1 is determined by the density of the magnetic flux which permeates through the electromagnetic induction based heat generating layer 1, and is distributed as shown by the graph in FIG. 6. In FIG. 6 which is a graph, the locational points on the fixing film 10 are plotted on the abscissa, being expressed by the angle θ from the center (0°) of the fixing nip, and the amount of the heat generated in the electromagnetic induction based heat generating layer 1 of the fixing film 10 is plotted on the axis of ordinates.

Figure 7:
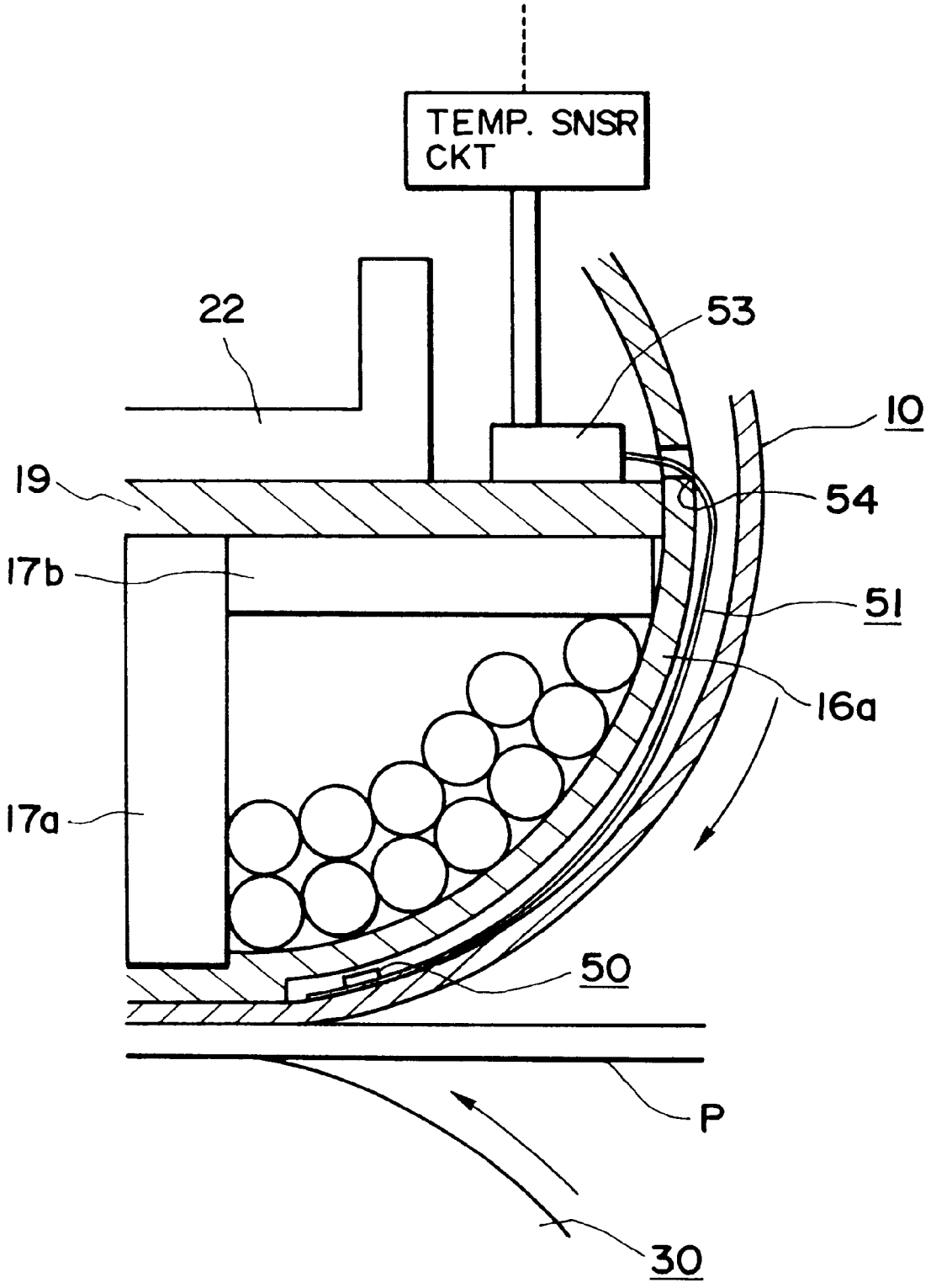
FIG. 7 is an enlarged view of the section surrounded by a dotted line in FIG. 2.
Figure 8:
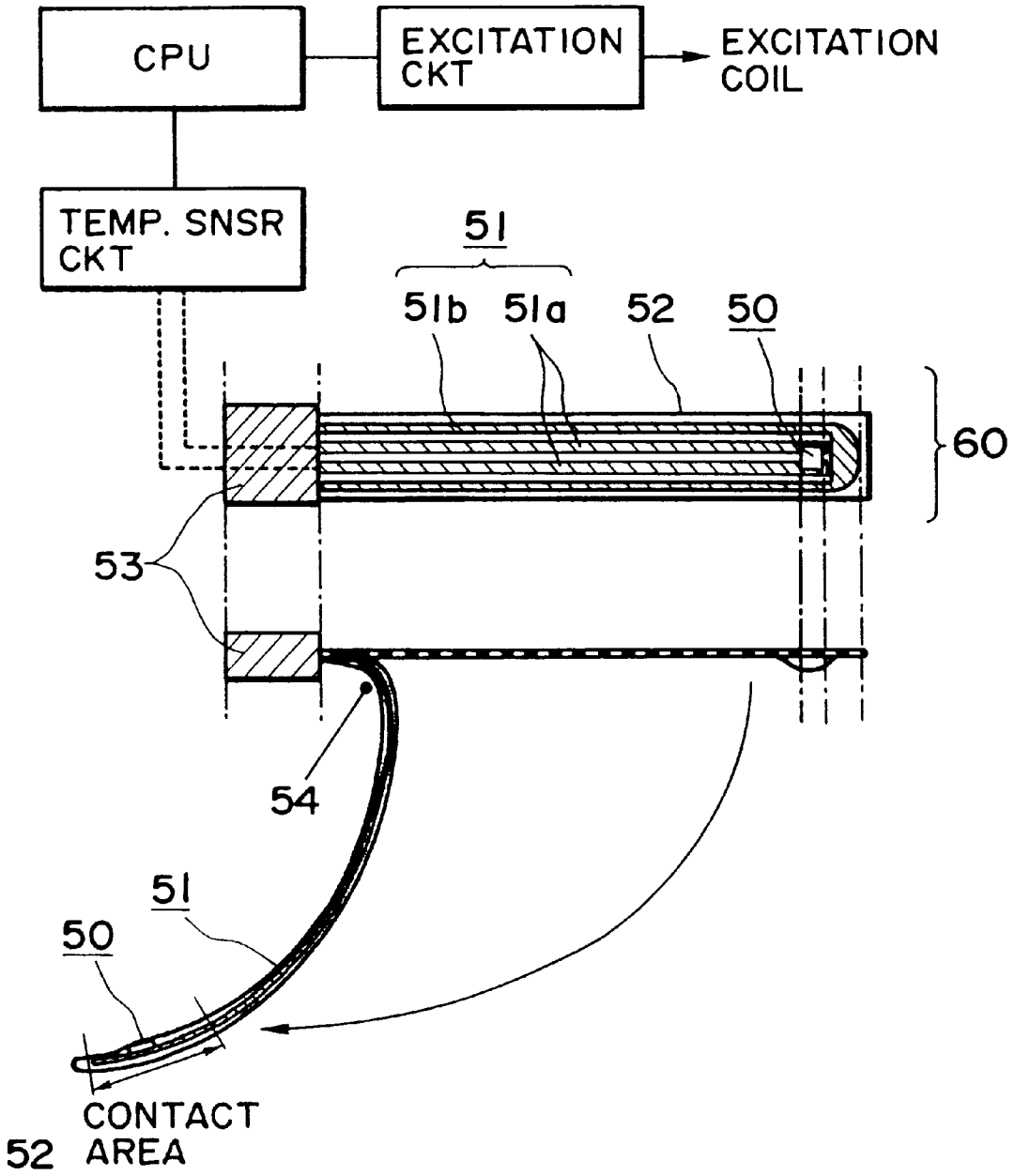
FIG. 8 is an explanatory drawing which depicts a temperature detecting means.

FIG. 7 is an enlarged view of the section adjacent to a temperature detecting element 50, surrounded by a dotted line in FIG. 2. FIG. 8 is a detailed picture of the temperature detecting element 50 illustrated in FIG. 7.

The temperature of the fixing nip N is maintained at a predetermined level by a CPU which controls the electric current supplied to the excitation coil 8 through the excitation circuit, while detecting the temperature data through the temperature detecting element 50. The temperature detecting element 50, which detects the temperature of the fixing film 10, is a temperature sensor such as a thermistor. In this embodiment, a temperature detecting means which comprises the temperature sensor 50 is placed in contact with the inward surface of the fixing film 10, on the area immediately before the fixing nip N, and the temperature of the fixing film 10 is controlled based on the temperature data from the temperature sensor 50 placed as described above.

Figure 9:
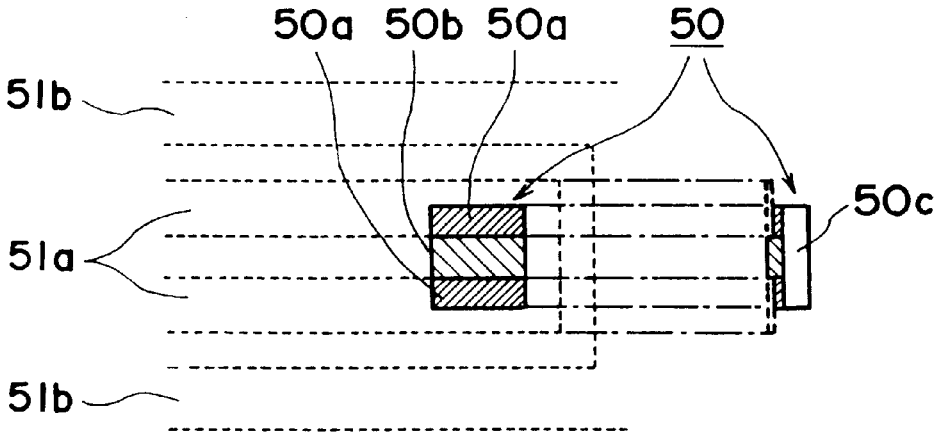
FIG. 9 is a schematic drawing of a temperature sensor.

FIG. 9 depicts the structure of the temperature sensor 50. The structure of the temperature sensor 50 is such that a thermistor portion 50*b*, that is, the temperature sensing portion, which has a negative temperature coefficient, and an electrode 50*a*, are printed, in a pattern, on the ceramic substrate 50*c*.

The electrode 50*a* of the temperature sensor 50, and a thin metallic electrode 51*a*, are glued together with unillustrated electrically conductive adhesive. The temperature sensor 50 is attached to an elastic, thermally conductive, thin metallic plate 51 as a supporting member. These components constitute a temperature detecting means 60.

The thin metallic plate 51 comprises the thin metallic plate electrode 51*a*, and a thin metallic guide plate 51*b* for protecting the thin metallic electrode 51*a*, and this thin metallic plate 51 is sandwiched between electrically insulative coats 52 to electrically insulate the thin metallic plate 51 from the fixing film 10. In this embodiment, the thin metallic plate 51 is a gold plated 0.07 mm thick plate of SUS 304. The thickness of the thin metallic plate 51 is desired to be no more than 0.2 mm since the smaller the thermal capacity of the thin metallic plate 51, the more advantageous the thin metallic plate 51, in terms of thermal responsiveness. As for the material for the insulative coat 52, 50 $\mu$m thick polyimide film is used. Since the insulative coat 52 has only to provide electrical insulation, the thinner the better.

In FIG. 8, in order to make it easier to identify the insulative coat 52, it is drawn as if separated from the thin metallic plate 51. However, in reality, the insulative coat 52 is placed perfectly in contact with the thin metallic plate 51; it may be glued to the thin metallic plate 51.

A referential figure 51 designates the mount for the thin metallic plate 51, and the lead wires to the temperature detection circuit are extended from this mount.

The thin metallic plate 51 is placed so that its longitudinal direction becomes parallel to the direction of the magnetic field (moving direction of the fixing film), and its widthwise direction becomes perpendicular to the magnetic field. This is due to the fact that eddy current is generated by electromagnetic induction, in the direction perpendicular to the direction of the magnetic flux, hence the amount of the eddy current to be generated can be reduced by reducing the dimension of the thin metallic plate 51 in the direction perpendicular to the direction of the magnetic flux (widthwise direction of the thin metallic plate 51). As long as the width of the thin metallic plate 51 is no more than 10 mm, the amount of the heat generated in the thin metallic plate 51 itself is so small that it does not have a negative effect on the temperature detection of the fixing film 10 by the temperature sensor 50. The contact area between the thin metallic plate 51 and the fixing film 10 is larger than the surface area of the temperature sensor 50.

The thin metallic plate 51 is bent at a point 54 and follows the curvature of the fixing film 10, in contact with the inward surface of the fixing film 10. The point 54 corresponds to the edge of the film guide 16*a* in FIG. 7. The temperature sensing portion 50*b* in this embodiment is between two thin metallic electrodes 51*a*, and the thin metallic plate 51 makes contact with the fixing film 10, by the surface opposite to the surface to which the temperature sensor 50 is attached.

Figure 10:
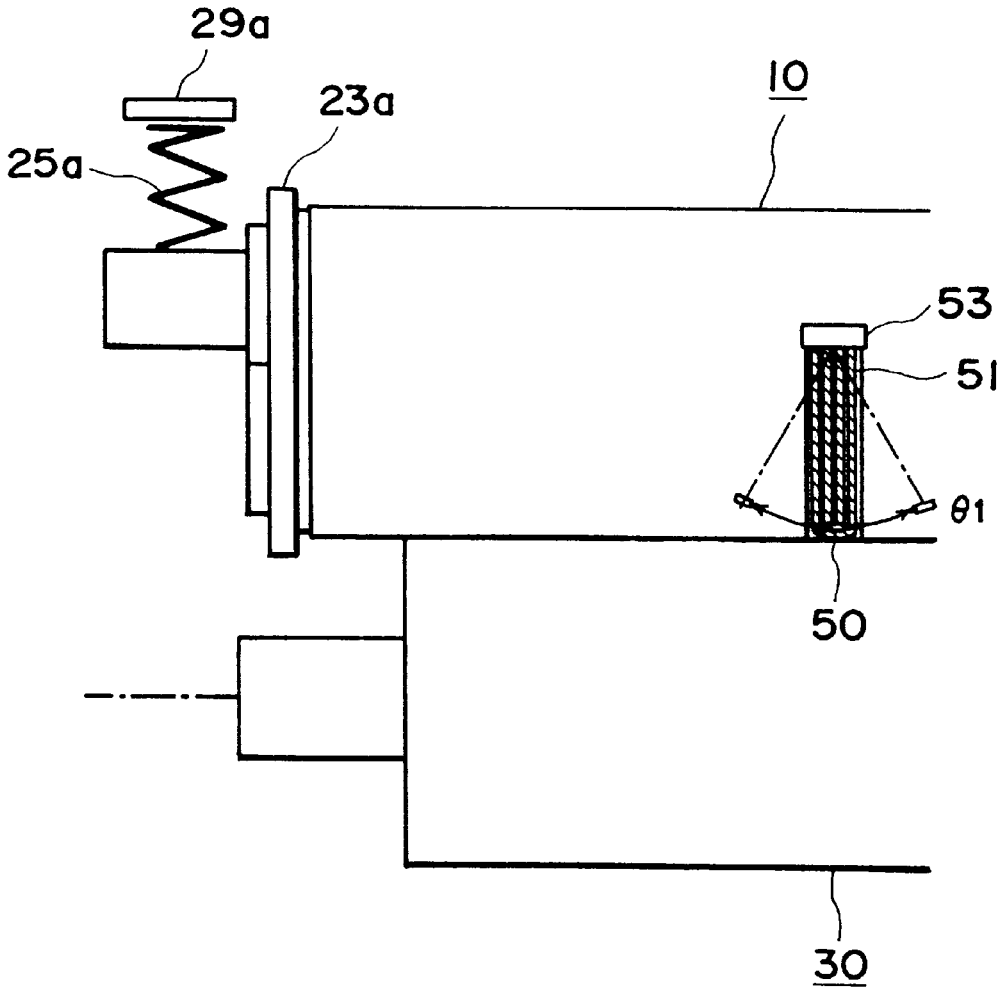
FIG. 10 is a picture of a mounted temperature sensor as seen from the direction in which the fixing film is moved in a fixing nip.

Referring to FIG. 10, an angle $\theta 1$, that is, the angle at which the thin metallic plate 51 is attached relative to the rotational direction of the fixing film 10, in other words, the angle of the line connecting the point 54 of the thin metallic plate 51 and the temperature sensor 50, relative to the rotational direction of the fixing film 10, is desired to satisfy the following formula: $-30° \leqq \theta 1 \leqq 30°$. This is because if the angle $\theta 1$ is out of the above range, the thin metallic plate 51 is liable to be turned over by the friction, and if the thin metallic plate 51 is turned over, the thin metallic plate 51 and the fixing film 10 fail to make proper surface-to-surface contact with each other.

As for the relationship between the point 54 and the thin metallic plate 51, the shortest distance $L_1$ between the point 54 and the fixing film 10, and the length $L_2$ of the thin metallic plate 51, are desired to satisfy a formula: $L_2 \geqq 2 \times L_1$. This is because a thin metallic plate 51 which satisfies a formula: $L_2 < 2 \times L_1$, is too short to be placed satisfactorily in contact with the fixing film 10; the thin metallic plate 51 is liable to remain partially separated from the fixing film 10 due to the friction between the thin metallic plate 51 and the fixing film 10. Thus, it is desirable that the formula: $L_2 \geqq 2 \times L_1$, is satisfied.

With the provision of the above described structure, the size of the area, by which the thin metallic plate 51 makes surface-to-surface contact with the fixing film 10, becomes greater as the thin metallic plate 51 is pressured by the fixing film 10, and therefore, not only the contact between the thin metallic plate 51 and the fixing film 10 becomes more stable, but also the thermal conductivity between the fixing film 10 and the temperature sensor 50 is improved. As a result, the accuracy and responsiveness of the temperature sensor 50 in detecting the temperature of the fixing film 10 are greatly improved.

According to this embodiment, the temperature sensor 50 constitutes a protrusion on the thin metallic plate 51. However, the thin metallic plate 51 makes contact with the fixing film 10 by the surface opposite to the surface with the temperature sensor 50, and therefore, the fixing film 10 is not in danger of being damaged by the protrusion.

Also, the temperature sensing portion 50*b* of the temperature sensor 50 is embedded between the two thin plate electrodes 50*a*, and therefore, the temperature sensing portion 50*b* can be placed much closer to the fixing film 10 than otherwise, to improve the responsiveness of the temperature sensor 50.

Further, according to this embodiment, the temperature detecting means is substantially immune to the effects of the generated magnetic field, and therefore, the thicknesses of the members which constitute the temperature detecting means can be reduced to produce a temperature detecting means, such as the one described in this embodiment, which is small in thermal capacity, and is very efficient in terms of space utilization, so that it can be placed in a minuscule space between the fixing film 10 and the film guide 16*a*.

Figure 11:
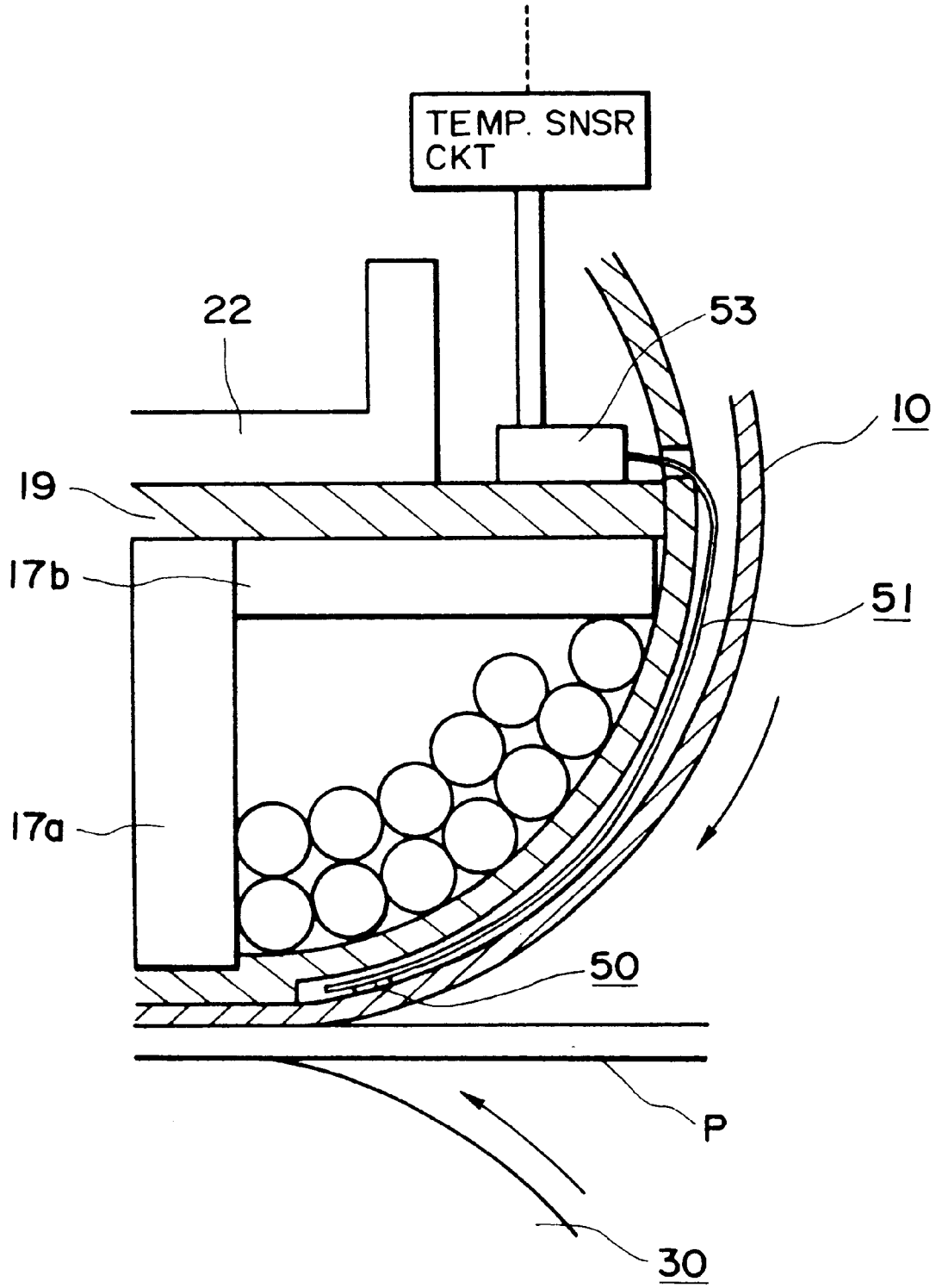
FIG. 11 is an explanatory drawing which depicts another embodiment of the present invention.
Figure 12:
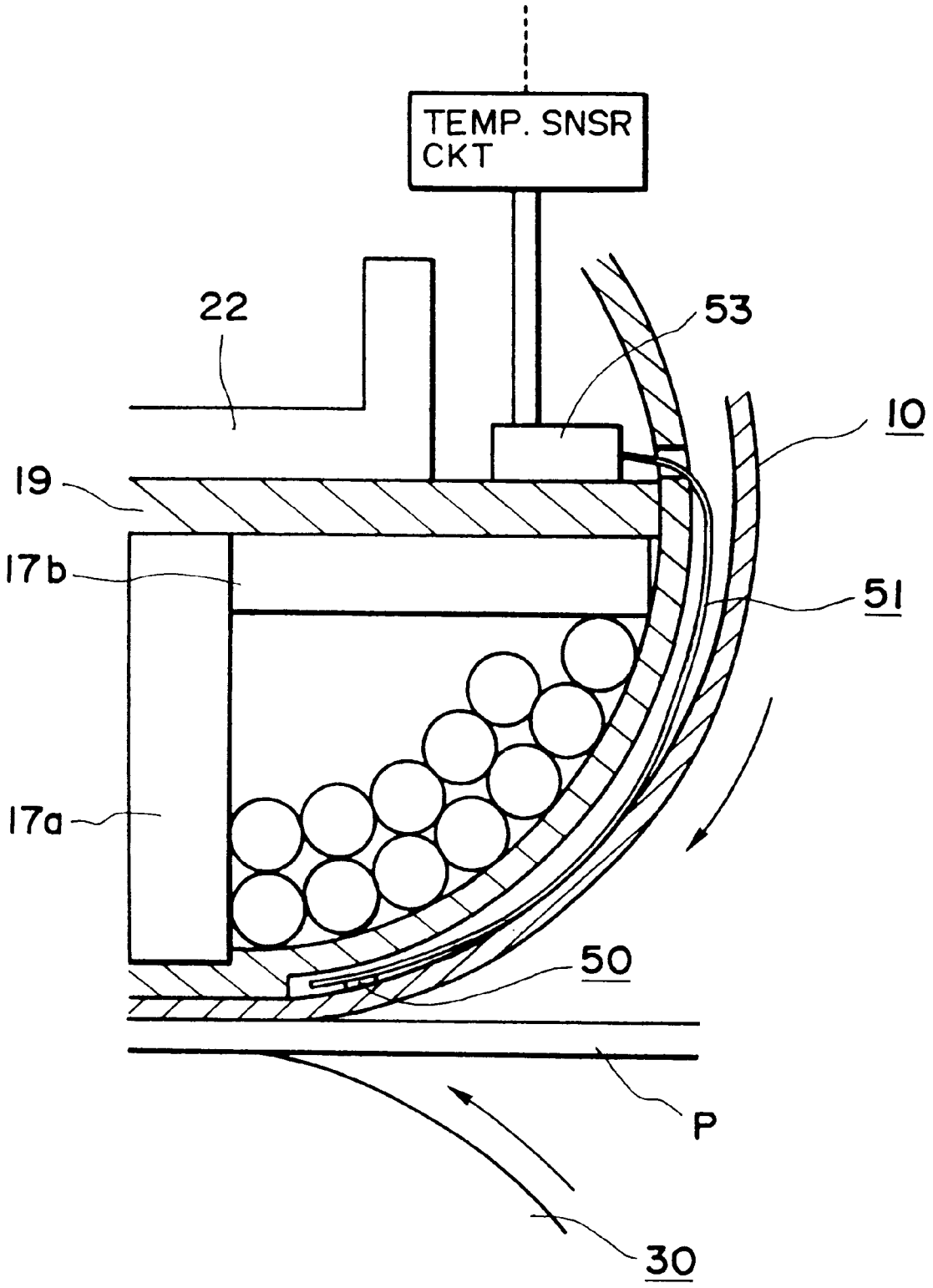
FIG. 12 is an explanatory drawing which depicts another embodiment of the present invention.
Figure 13:
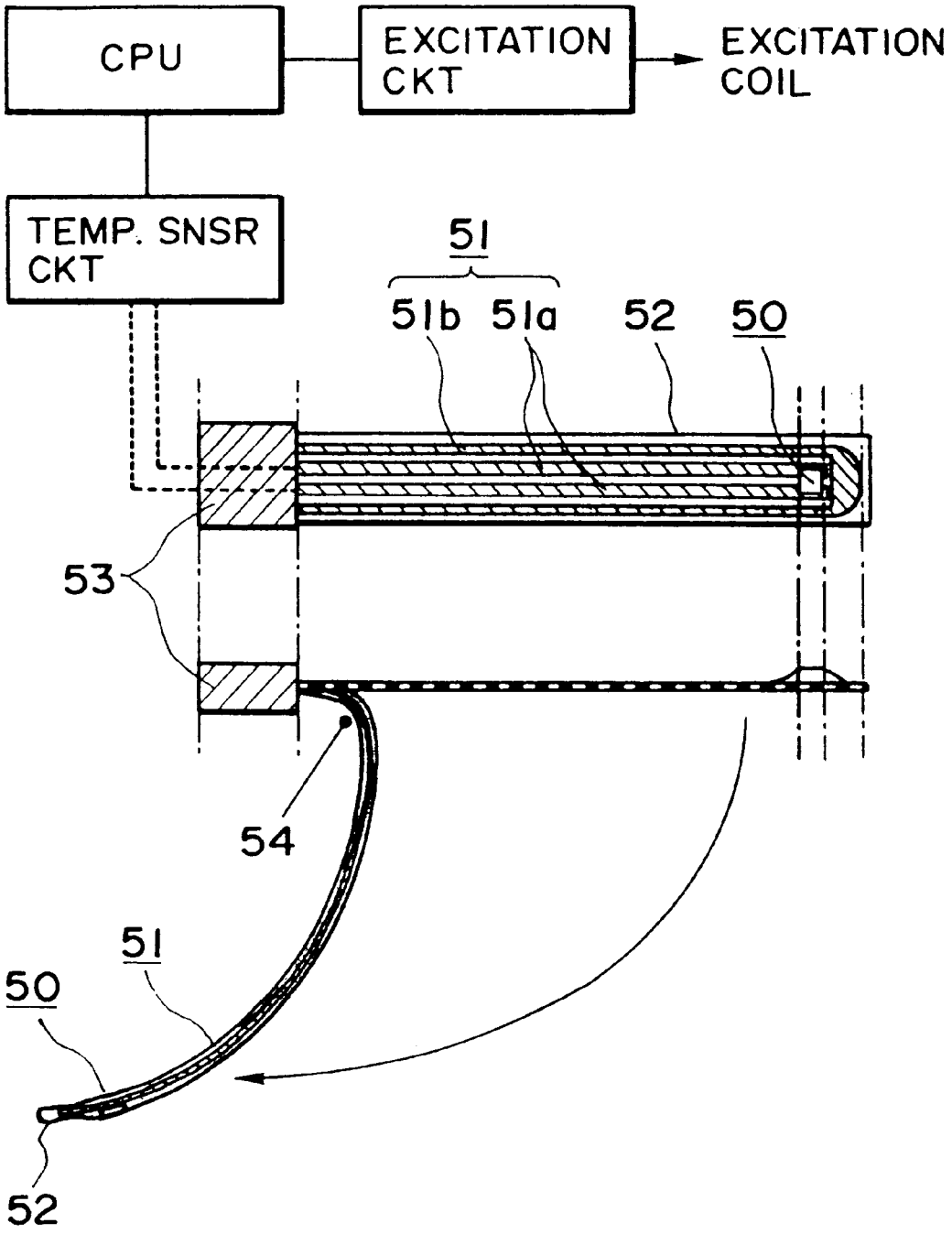
FIG. 13 is an explanatory drawing which depicts a temperature detecting means.

Further, according to this embodiment, the temperature sensor 50 is placed virtually in contact with the fixing film 10, with the interposition of the thin metallic plate 51 and the insulative coat 52. However, when a reasonable degree of responsiveness is all that is necessary as it is in the case of a slow image forming apparatus like a low speed laser beam printer, and also there is no danger of the fixing film 10 being damaged, the positional relationship between the temperature sensor 50 and thin metallic plate 51 may be reversed; the temperature sensor 50 may be placed directly in contact with the fixing film 10, in other words, without the interposition of the thin metallic plate 51. In this case, only the temperature sensor 50 may be placed in contact with the fixing film 10 as illustrated in FIG. 11, or both the thin metallic plate 51 and the temperature sensor 50 may be placed in contact with the fixing film 10 as illustrated in FIG. 12, in order to increase the thermal conductivity between the two components. FIG. 13 is a detailed illustration of the temperature sensing portion extracted from FIG. 11 or 12.

Thus, as the pressure roller 30 is rotatively driven, the cylindrical fixing film 10 is rotated along the outward surfaces of the film guide 16*a* and the top film guide 16*b*, and electrical current is supplied to the excitation coil 18 within the film guide from the excitation circuit to generate heat in the fixing film 10 through electromagnetic induction. As a result, the temperature of the fixing nip N is increased. As the temperature of the fixing nip N reaches the predetermined level, it is maintained at this level. With the heating apparatus in this state, a recording medium P, on which a toner image t has been just deposited without being fixed thereto, is introduced into the fixing nip N. between the fixing film 10 and the pressure roller 30, with the image bearing surface of the recording medium P facing upward so that it will come in contact with the outward surface of the film 10. Then, the recording medium P is passed through the fixing nip N, along with the fixing film 10, while being compressed by the pressure roller 30 and the film guide 16, with the image bearing surface being flatly in contact with the outward surface of the fixing film 10. While the recording medium P, bearing the yet-to-be-fixed toner image t, is passed through the fixing nip N as described above, this toner image t borne on the recording medium P is heated by the heat electromagnetically induced in the fixing film 10, being thereby fixed to the recording medium P. After passing through the fixing nip N, the recording medium P separates from the outward surface of the rotating fixing film 10, and is conveyed further to be discharged from the image forming apparatus. After passing through the fixing nip N while being thermally fixed to the recording medium P, the toner image cools down and becomes a permanently fixed image.

In this embodiment, such toner that contains ingredients, which control the excessive softening of the toner, is used, and therefore, the fixing apparatus is not provided with an oil coating mechanism for offset prevention. When toner which does not contain the softening controlling ingredient is used, the fixing apparatus may be provided with an oil coating mechanism. Further, even when the toner which contains the softening controlling ingredient is used, the oil may be applied and the recording medium P may be separated by cooling.

Next, the excitation coil 18 and fixing film 10 will be described.

(A) Excitation Coil 18

The material for the excitation coil 18 is copper. More specifically, a plurality of fine copper wires, each of which is individually coated with electrically insulative material, are bundled, and this bundle of insulator coated fine wires is wound a given number of turns to form the excitation coil 18. In this embodiment, the bundle of wires is wound 12 times.

As for the insulator for coating the copper wires, heat resistant insulator is recommendable in consideration of the conduction of the heat generated in the fixing film 10. In this embodiment, polyimide is used to coat the fine wires. The thermal deformation point of the insulative coat is 220° C.

The density of the coil wires may be increased by applying external pressure to the excitation coil 18.

In order to make the heat generating layer of the fixing film 10 efficiently absorb the magnetic field generated by the excitation coil 18 and the magnetic cores 17*a*, 17*b*, and 17*c*, the distances between the excitation coil 18 and the heat generating layer 1 of the fixing film 10, and between the magnetic cores 17*a*, 17*b*, and 17*c* and the heat generating layer 1 of the fixing film 10, are desired to be as small as possible.

Therefore, in this embodiment, the excitation coil 18 is shaped to conform to the curvature of the heat generating layer 1, as illustrated in FIG. 2. The distance between the heat generating layer 1 of the fixing film 10 and the excitation coil 18 is set at approximately 1 mm.

As for the material for the film guides 16*a* and 16*b*, electrically insulative and heat resistant material is recommendable in order to satisfactorily insulate the excitation coil 18 from the fixing film 10. For example, phenol resin, fluorinated resin, polyimide resin, polyamide resin, polyamide-imide resin, PEEK resin, PES resin, PPS resin, PFA resin, PTFE resin, FEP resin, LCP, and the like are desirable candidates for the selection.

The wires 18*a* and 18*b*, which lead from the excitation coil 18, and are put through the film guide 16*a*, are covered with insulative coating, on the portions outside the film guide 16*a*.

(B) Fixing Film 10

Figure 14:
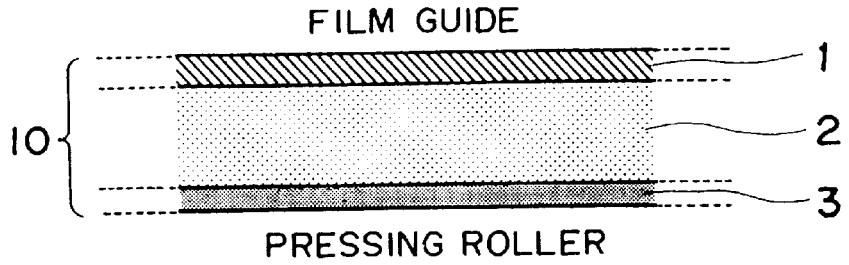
FIG. 14 is a schematic vertical section of a fixing film.
Figure 15:
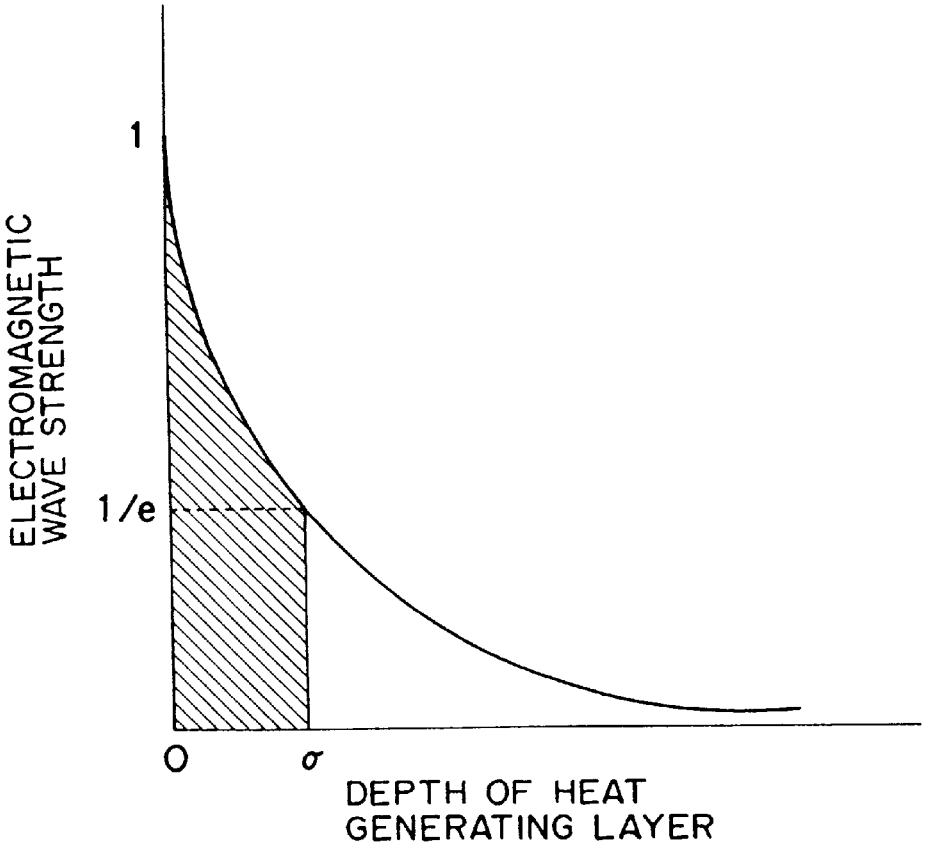
FIG. 15 is a graph which shows the relationship between the depth in a heating layer and the strength of the electromagnetic wave.

FIG. 14 is a schematic vertical section of the fixing film 10 in this embodiment. This fixing film 10 has a compound (laminar) structure, that is, an electrically conductive layer, comprising: the heat generating layer 1, which is formed of metallic film or the like, and constitutes the base layer of the fixing film 10; the elastic layer 2 laid on the outward surface of the heat generating layer 1; and the lubricous layer 3 laid on the outward surface of the elastic layer 2. In order to assure the adhesion between the heat generating layer 1 and the elastic layer 2, and the adhesion between the elastic layer 2 and the lubricous layer 3, primer layers (unillustrated) may be placed between the correspondent layers. The heat generating layer 1 is on the inward side of the cylindrical fixing film 10, and the lubricous layer 3 is on the outward side. As described above, as alternating magnetic flux acts on the heat generating layer 1, eddy current is generated in the heat generating layer 1, and this eddy current generates heat in the heat generating layer 1. The thus generated heat heats the fixing film 10 through the elastic layer 2 and the lubricous layer 3, and in turn, the fixing film 10 heats the recording medium, that is, an object to be heated, which is being passed through the fixing nip N, to thermally fix the toner image.

a. Heat Generating Layer 1

The heat generating layer 1 may be composed of non-magnetic metal, but usage of highly magnetic material such as nickel, iron, magnetic SUS, nickel-cobalt alloy, or the like is preferable.

As for the thickness of the heat generating layer 1, it is desired to be no less than the skin depth σ (m) expressed by the formula given below, and no more than the 200 μm:

$$\sigma=503\times(\rho/f\mu)^{1/2}$$

wherein, a referential code f stands for the frequency (Hz) of the excitation circuit; μ, the magnetic permeability; and ρ stands for specific resistance (Ωm).

The thickness of the heat generating layer 1 is desired to be in a range of 1–100 μm. If the thickness of the heat generating layer 1 is no more than 1 μm, all the electromagnetic energy cannot be a absorbed; heat generating efficiency deteriorates. If the thickness of the heat generating layer 1 exceeds 100 μm, the heat generating layer 1 becomes too rigid; in other words, its flexibility is lost too much to be practically used as a rotatory member. Hence, it is desirable that the thickness of the heat generating layer 1 is in a range of 1–100 μm.

b. Elastic Layer 2

The elastic layer 2 is composed of such material that is good in heat resistance and thermal conductivity; for example, silicone rubber, fluorinated rubber, fluoro-silicone rubber, and the like.

The thickness of the elastic layer 2 is desired to be in a range of 10–500 μm, which is necessary to assure the quality of the fixed image after fixation.

When printing a color image, in particular, a photographic image, a large proportion of the recording medium P surface is likely to be solidly covered with toner. In such a case, if the actual heating surface (lubricous surface layer 3) cannot conforms to the irregularities of the recording medium P surface, or toner layer, heating becomes nonuniform, creating difference in glossiness between the areas to which a relatively large amount of heat is conducted, and the areas to which a relatively small amount of heat is conducted; the areas which receive a relatively large amount of heat displays a higher degree of glossiness than the areas which receive relatively small amount of heat. As for the thickness of the elastic layer 2, if it is no more than 10 μm, it fails to conform to the irregularities of the toner layer, and causes glossiness to be uneven across the images. If it exceeds 1,000 μm, the thermal resistance of the elastic layer 2 becomes too large for a fixing apparatus to be quickly started up. Therefore, the thickness of the elastic layer 2 is preferably in a range of 50–500 μm.

As for the hardness of the elastic layer 2, the excessive hardness of the elastic layer 2 does not allow the elastic layer 2 to conform to the irregularities of the recording medium surface or the toner layer, causing glossiness to be uneven across an image. Hence, it is desirable that the hardness of the elastic layer 2 is no more than 60° (JIS-A), preferably, no more than 45° (JIS-A).

The thermal conductivity λ of the elastic layer 2 is desired to be $6\times10^{-4}$~$2\times10^{-3}$ (cal/cm·sec·deg.):

$$\lambda=6\times10^{-4}\sim2\times10^{-3}\ \text{(cal/cm·sec·deg.)}.$$

When the thermal conductivity λ is no more than $6\times10^{-4}$ (cal/cm·sec·deg.), the thermal resistance becomes large, which slows down the speed at which the temperature of the surface layer (lubricous layer 3) of the fixing film 10 rises.

When the thermal conductivity λ is no less than $2\times10^{-3}$ (cal/cm·sec·deg.), the hardness of the elastic layer 2 increases too much, and also the permanent deformation of the elastic layer 2 caused by compression worsens.

Therefore, it is desirable that the heat conductivity is in the range of $6\times10^{-4}$~$2\times10^{-3}$ (cal/cm·sec·deg.), preferably in a range of $8\times10^{-4}$~$1.5\times10^{-3}$ (cal/cm·sec·deg.).

c. Lubricous Layer 3

As for the material for the lubricous layer 3, it can be selected from among such material as fluorinated resin, silicone resin, fluoro-silicone rubber, fluorinated rubber, silicone rubber, PFA, PTFE, FEP, or the like, which is desirable in terms of lubricity (mold releasing properties) and heat resistance.

The thickness of the lubricous layer 3 is desired to be in a range of 1–100 μm. If the thickness of the lubricous layer 3 is no more than 1 μm, the unevenness of the lubricous layer 3 manifests as lubricous unevenness, creating spots inferior in lubricity or durability. On the other hand, if the thickness of the lubricous layer 3 is no less than 100 μm, thermal conductivity deteriorates; in particular, if the lubricous layer 3 is composed of resin, the hardness of the lubricous layer 3 becomes too high to be effective as the elastic layer 2.

Figure 16:
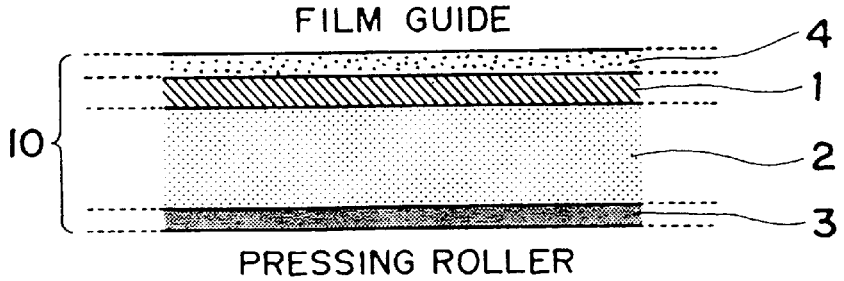
FIG. 16 is a schematic vertical section of another fixing film.
Figure 17:
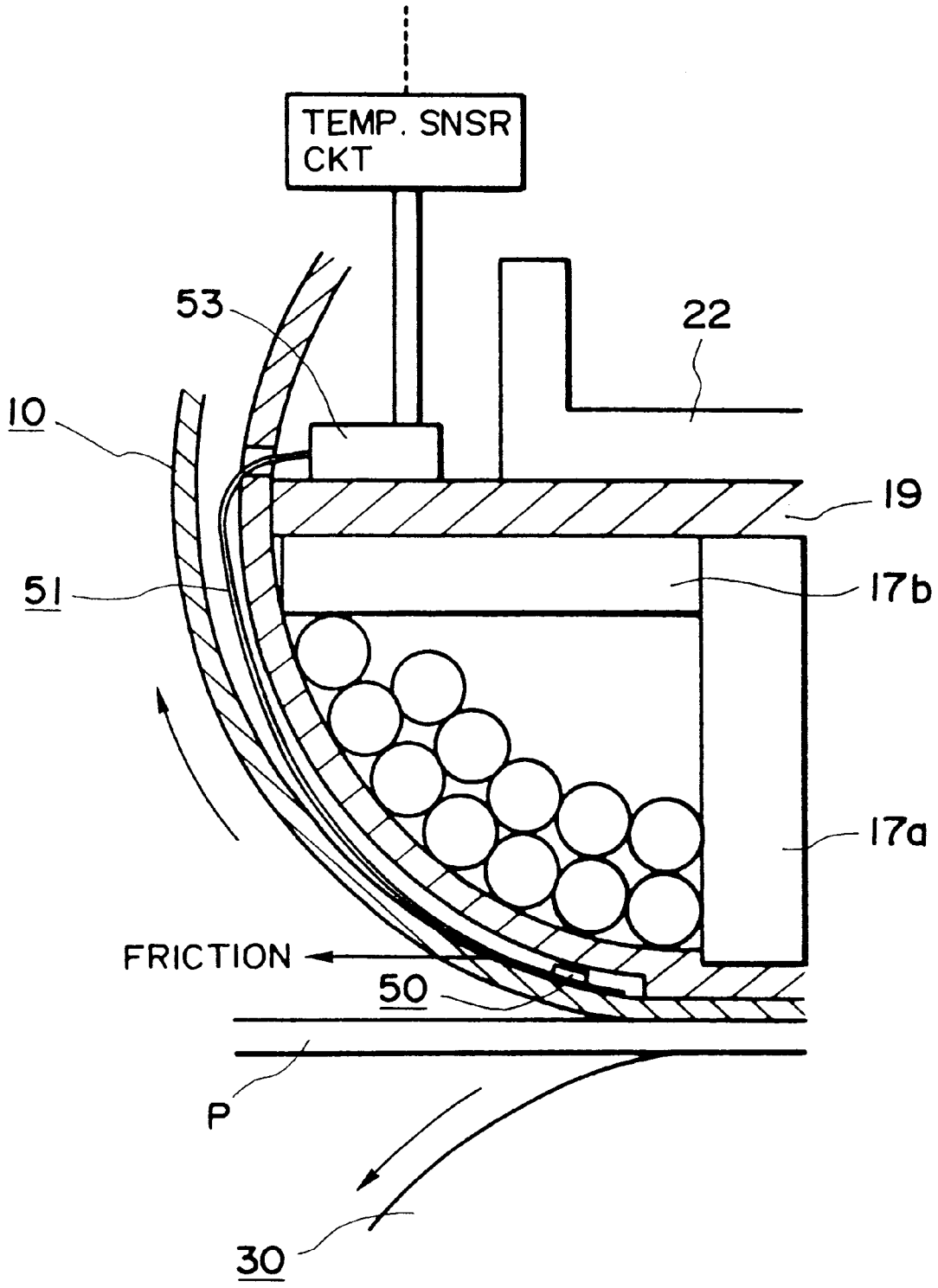
FIG. 17 is a schematic cross section of the essential portion of the heating apparatus in another embodiment of the present invention.
Figure 18:
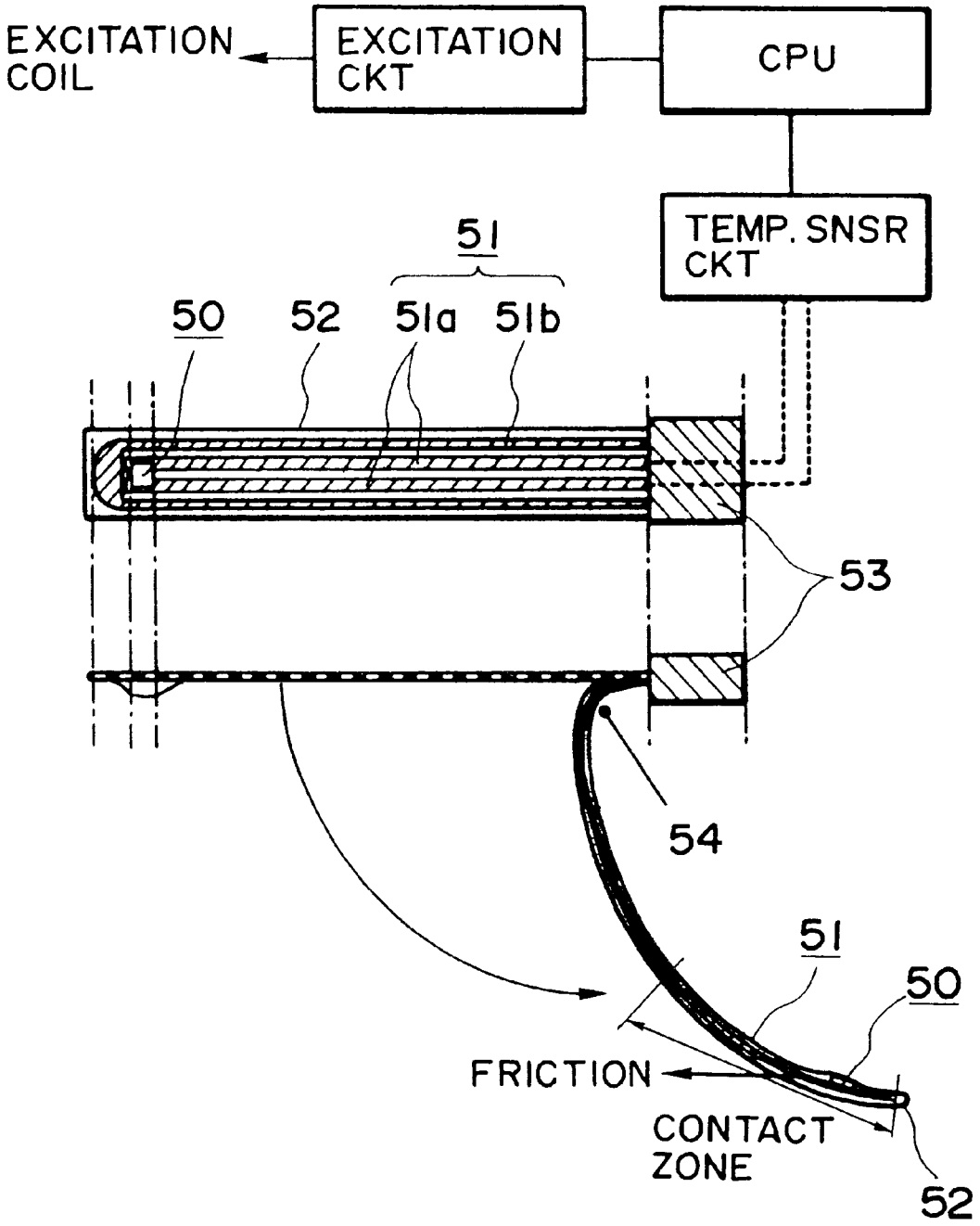
FIG. 18 is an explanatory drawing which depicts another temperature detecting means.

Referring to FIG. 16, in the laminar structure of the fixing film 10, a thermally insulative layer 4 may be disposed on the exposed surface (surface opposite to the elastic layer 2) of the heat generating layer 1.

As for the material for the thermally insulative layer 4, heat resistant resin, for example, fluorinated resin, polyimide resin, polyamide resin, polyamide-imide resin, PEEK resin, PES resin, PPS resin, PFA resin, PTFE resin, FEP resin, or the like is recommendable.

As for the thickness of the thermally insulative layer 4, it is desired to be in a range of 10–1,000 μm. If the thickness of the thermally insulative layer 4 is no more than 10 μm, the layer 4 is not effective as a thermally insulative layer, and also lacks durability. On the other hand, if the thickness of the thermally insulative layer 4 exceeds 1,000 μm, the distance from the magnetic cores 17*a*, 17*b*, and 17*c* to the heat generating layer 1 becomes too large to allow the magnetic flux to be sufficiently absorbed by the heat generating layer 1.

The thermally insulative layer 4 prevents the heat generated in the heat generating layer 1 from conducting inward of the loop of the fixing film 10, and therefore, the ratio of the heat conducted toward the recording medium P increases compared to when the thermally insulative layer 4 is not present. As a result, power consumption decreases.

As is evident from the above description, according to this embodiment, the temperature detecting means is placed in contact with the inward surface of the fixing film, and therefore, the film temperature can be detected without fear of damaging the outward surface of the film, eliminating negative effect of the contact between the temperature detecting means and the fixing film. Further, the temperature detection element is first attached to a resilient thin metallic plate, and then, the thin metallic film is placed in contact with the fixing film. Therefore, the thermal relationship between the temperature detection element and the fixing film is stabilized. In addition, since the thin metallic film which has a wider contact area than the temperature detection element itself is interposed between the temperature detection element and the fixing film, the heat from the fixing film is more reliably conducted to the temperature detection element. Therefore, the responsiveness of the temperature detection element in terms of temperature detection is improved, hence the fixing film temperature can be controlled with high accuracy.

Next, another embodiment of the present invention will be described.

Referring to FIGS. 7 and 8, in this embodiment, a temperature sensor 50 is disposed after the fixing nip N relative to the rotational direction of the fixing film. Otherwise, the structure of the fixing apparatus in this embodiment is identical to that in the preceding embodiment. Therefore, the components and the portions thereof which are identical to those in the preceding embodiment are designated with the identical referential codes to omit the repetition of the same description.

Also in this embodiment, the thin metallic plate 51 is fixed to the mount 53 by one of the longitudinal ends, leaving the other end as a free end. However, in this embodiment, the thin metallic plate 51 is installed in a manner to oppose the rotational direction of the fixing film 10; the free end of the thin metallic plate 51 is on the upstream side relative to the rotational direction of the fixing film 10. With this arrangement, the thin metallic plate 51 is more firmly pressed against the fixing film 10 by the friction between the thin metallic plate 51 and the fixing film 10 than otherwise. Therefore, the size of the contact area between the fixing film 10 and the thin metallic plate 51 is further increased, hence more effectively conducting the heat, and in addition, the contact between the fixing film 10 and thin metallic plate 51 is more stabilized.

Placing the thin metallic plate 51 in contact with the fixing film 10 in the counter direction to the rotational direction of the fixing film 10 increases the contact pressure between the thin metallic plate 51 and the fixing film 10, and therefore, heat is more effectively conducted. As a result, the responsiveness of the temperature sensor 50 is improved; heat detection accuracy is improved. It should be noted here that if the revolution of the fixing film 10 reaches a high level, with the thin metallic plate 51 being fitted in conformity with the rotational direction of the fixing film as it is in the preceding embodiment, the friction between the thin metallic plate 51 and the fixing film works in the direction to cause the thin metallic plate 51 to become separated from the fixing film, whereas in the case of the structure in this embodiment, the friction works in the direction to cause the thin metallic plate 51 to adhere to the fixing film, and therefore, the thin metallic plate 51 does not separate from the fixing film. However, in consideration of the fact that that the thin metallic plate 51 is installed in a manner to oppose the rotational direction of the fixing film, it is desirable that the attachment angle of the thin metallic plate 51 relative to the rotational direction of the fixing film 10, in other words, the angle θ (FIG. 10) of the line connecting the point 54 of the thin metallic plate 51 and the temperature sensor 50, relative to the rotational direction of the fixing film 10, satisfies the following formula: $-20° \leqq \theta \leqq 20°$. This is because if the angle θ is outside the above range, it is easier for the thin metallic plate 51 to be turned over, and if turned over, the thin metallic plate 51 and the fixing film 10 fail to make satisfactory surface-to-surface contact with each other.

The relationship between the point 54 and the thin metallic plate 51 is desirable to be such that the shortest distance $L_1$ between the point 54 and the fixing film 10 and the length $L_2$ of the thin metallic plate 51 satisfies the following formula: $L_2 \geqq 2 \times L_1$. This is because, if $L_2 < 2 \times L_1$, the thin metallic plate 51 is too short to prevent the thin metallic plate 51 from being turned over by the friction between the fixing film 10 and the thin metallic plate 51, and if turned over, the temperature of the fixing film 10 cannot be detected. Thus, it is desirable that the relation between $L_2$ and $L_1$ satisfies the above formula: $L_2 \geqq 2 \times L_1$.

In the case of a slow apparatus, satisfactory results can be obtained even when the thin metallic plate 51 is arranged in conformity with the rotational direction of the fixing film 10 as it is in the preceding embodiment, but in the case of a high speed apparatus, it is desirable that the thin metallic plate 51 is arranged in the direction opposite (counter) to the rotational direction of the fixing film 10 as it is in this embodiment, so that a contact area of a satisfactory size can be reliably maintained between the thin metallic plate 51 and the fixing film 10 to assure accurate detection of the temperature of the fixing film 10 by the temperature sensor 50.

The advantage of the structure of this embodiment is more apparent when the structure is applied to a high speed apparatus, but the same effect can be also obtained even when applied to a medium speed apparatus. However, in the case of a slow speed apparatus, the positional relationship between the temperature sensor 50 and the thin metallic plate 51 may be reversed; the temperature sensor 50 may be placed directly in contact with the fixing film 10. In such a case, it may be only the temperature sensor 50 that is placed in contact with the fixing film 10, or the thin metallic plate 51 may also be placed in contact with the fixing film 10 for the sake of effective heat conduction.

The temperature sensor 50 may be disposed both before and after the fixing nip N.

With this arrangement, the difference ΔT between the fixing film temperature measured before the fixing nip N and the fixing film temperature measured after the fixing nip N can be obtained to determine the amount of the heat robbed by the recording medium P in the fixing nip N.

Thus, a predetermined amount of heat can be supplied to the recording medium P by controlling the temperature of the fixing film so that the temperature difference ΔT remains the same. With such temperature control, it does not occur that an excessive amount of heat is applied to the recording medium P. In other words, electric power consumption is reduced.

Also, the temperature difference ΔT can be varied according to the type of the recording medium to control the temperature of the fixing apparatus to suit the properties of the recording medium P.

Further, according to the present invention, the elastic layer 2 of the electromagnetic induction based fixing film 10 may be omitted when the heating apparatus is to be used for thermally fixing a monochromatic image or a single pass multicolor image. The heat generating layer 1 may be formed of compound material composed by mixing metallic filler into resin. Further, the fixing film 10 may be constituted of a heat generating layer only.

The positioning of the magnetic field generating means (magnetic flux generating means) does not need to limited to the positioning described in the preceding embodiment. For example, it may be as illustrated in FIG. 19.

Also, the film driving system employed in the heating apparatus as the fixing apparatus 100 does not need to be limited to the pressure roller based driving system.

Figure 20:
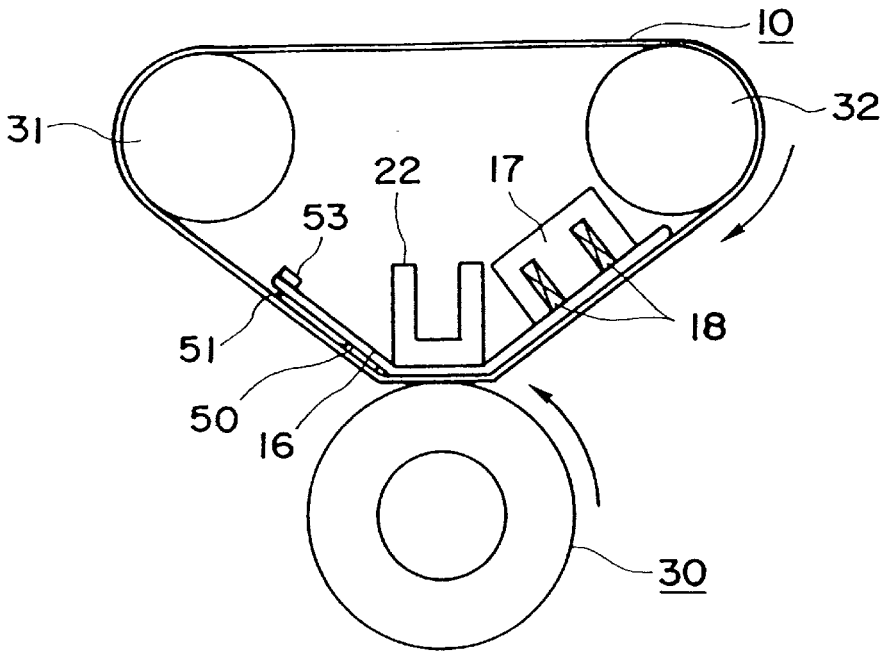
FIG. 20 is a schematic cross section of the fixing apparatus in another embodiment of the present invention.

For example, the film driving system may be such as the one illustrated in FIG. 20, in which an electromagnetic induction based fixing film 10 in the form of an endless belt is suspended around a film guide 16, a driving roller 31, and a tension roller 32, and a pressure roller 30 as a pressing member is pressed upon the downward facing surface of the film guide 16, forming a fixing nip N, with the fixing film 10 sandwiched between the film guide 16 and the pressure roller 30, wherein the fixing film 10 is rotatively driven by the driving roller 31. In this setup, the pressure roller 30 is a follower roller.

Further, the pressing member 30 does not need to be in the form of a roller; it may take other forms such as a rotatory belt.

The thermal energy to be supplied to the recording medium may come from the pressing member side, as well as from the fixing film side. In such a case, the heat generating means such as the electromagnetic induction based heating means is provided not only on the fixing film side, but also, on the pressing member side, to heat the pressing means side to a predetermined temperature level and maintain the temperature of the pressing member side at the predetermined level.

Further, application of the heating apparatus in accordance with the present invention is not limited to the image forming apparatus described in the embodiments of the present invention. Instead, the heating apparatus in accordance with the present invention can be applicable to a wide range of means or apparatuses for thermally processing an object to be heated; for example, an image heating apparatus that heats a printed recording medium to improve its surface properties, such as glossiness, an image heating apparatus that temporarily fixes an image, and other types of heating apparatuses, for example, a drying apparatus that thermally dries an object to be heated, or a thermal laminating apparatus.

While the invention has been described with reference to the structures disclosed herein, it is not confined to the details set forth, and this application is intended to cover such modifications or changes as may come within the purposes of the improvements or the scope of the following claims.

What is claimed is:

1. An image heating apparatus comprising:

an endless movable member;

a coil for generating a magnetic flux, wherein eddy current is generated in said movable member by the magnetic flux generated by said coil, by which said movable member generates heat;

a core for guiding a magnetic flux;

a back-up member for forming a nip with said movable member and wherein a recording material carrying an image is fed by said nip, and the image on the recording material is heated by the heat from said movable member; and temperature detecting means for detecting a temperature of said movable member;

wherein a power supply to said coil is controlled on the basis of an output of said temperature detecting means, and said temperature detecting means includes a temperature sensor and an elastic supporting member for supporting said temperature sensor, and said temperature detecting means is contacted to said movable member by its elasticity, and wherein said core is sandwiched by said coil at a position upstream of said nip with respect to a movement direction of an outer periphery of said movable member, and said temperature detecting means is disposed downstream of said nip.

2. An apparatus according to claim 1, wherein said core is provided inside of said coil.

3. An apparatus according to claim 1, wherein said supporting member has a fixed end and a free end, and said temperature sensor is provided at the free end of said supporting member.

4. An apparatus according to claim 1, wherein said coil and said core are disposed inside said movable member.

5. An apparatus according to claim 1, wherein said movable member is in the form of a film having an electroconductive layer.

6. An apparatus according to claim 5, wherein said temperature detecting means is contacted to an inner surface of said movable member.

7. An apparatus according to claim 1, wherein an unfixed image is fixed on a recording material by the heat from said movable member.

* * * * *

UNITED STATES PATENT AND TRADEMARK OFFICE

CERTIFICATE OF CORRECTION

PATENT NO. : 6,343,195 B1
DATED : January 29, 2002
INVENTOR(S) : Atsuyoshi Abe et al.

It is certified that error appears in the above-identified patent and that said Letters Patent is hereby corrected as shown below:

Column 3,
Line 38, "structure the" should read -- structure of the --.

Column 5,
Line 49, "color." should read -- color --.

Column 6,
Line 17, "and-while" should read -- and-white --.

Column 11,
Line 17, "N." should read -- $N_1$ --.

Column 13,
Line 13, "conforms" should read -- conform --.

Signed and Sealed this

Twenty-third Day of April, 2002

*Attest:*

*Attesting Officer*

JAMES E. ROGAN
*Director of the United States Patent and Trademark Office*